US009809931B2

(12) United States Patent
Zwick et al.

(10) Patent No.: US 9,809,931 B2
(45) **Date of Patent: *Nov. 7, 2017**

(54) DISPERSIBLE HYDROENTANGLED BASESHEET WITH TRIGGERABLE BINDER

(71) Applicant: Kimberly-Clark Worldwide, Inc., Neenah, WI (US)

(72) Inventors: Kenneth John Zwick, Neenah, WI (US); Nathan John Vogel, Neenah, WI (US); WanDuk Lee, Appleton, WI (US); Joseph Kenneth Baker, Cumming, GA (US); Colin Ackroyd, Horsham (GB)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/241,324

(22) Filed: Aug. 19, 2016

(65) Prior Publication Data

US 2016/0355979 A1 Dec. 8, 2016

Related U.S. Application Data

(62) Division of application No. 15/075,638, filed on Mar. 21, 2016, now Pat. No. 9,453,304, which is a division of application No. 14/643,545, filed on Mar. 10, 2015, now Pat. No. 9,320,395, which is a division of application No. 14/169,859, filed on Jan. 31, 2014, now Pat. No. 9,005,395.

(51) Int. Cl.

| | |
|---|---|
| ***D21H 21/20*** | (2006.01) |
| ***D21H 17/45*** | (2006.01) |
| ***D04H 1/49*** | (2012.01) |
| ***D04H 1/587*** | (2012.01) |
| ***B08B 1/00*** | (2006.01) |

(52) U.S. Cl.

CPC ..... *D21H 21/20* (2013.01); *B08B 1/006* (2013.01); *D04H 1/49* (2013.01); *D04H 1/587* (2013.01); *D21H 17/45* (2013.01)

(58) Field of Classification Search

CPC ..... D21H 25/005; D21H 13/08; D21H 13/14; D21H 13/24; D21H 13/26; D21H 17/37; D21H 21/18; D21H 23/28; D21H 17/45; D21H 21/20; A47L 13/16; D04H 1/492; D04H 1/498; D04H 1/465; D04H 18/04; D04H 13/005; D04H 1/49; D04H 1/587; D21F 11/06; A47K 7/02

USPC .... 162/109, 115, 123, 141, 146, 149, 157.6, 162/157.7, 164.1, 168.1, 197; 28/103–105; 428/156, 172, 195.1, 341; 442/408, 415–416; 15/104.93, 118

See application file for complete search history.

(56) References Cited

U.S. PATENT DOCUMENTS

| | | | | |
|---|---|---|---|---|
| 4,117,187 | A | 9/1978 | Adams et al. | |
| 4,755,421 | A | 7/1988 | Manning et al. | |
| 5,009,747 | A | 4/1991 | Viazmensky et al. | |
| 5,281,306 | A | 1/1994 | Kakiuchi et al. | |
| 5,292,581 | A | 3/1994 | Viazmensky et al. | |
| 5,770,528 | A | 6/1998 | Mumick et al. | |
| 5,935,880 | A | 8/1999 | Wang et al. | |
| 5,976,694 | A | 11/1999 | Tsai et al. | |
| 5,986,004 | A | 11/1999 | Pomplun et al. | |
| 6,043,317 | A | 3/2000 | Mumick et al. | |
| 6,537,663 | B1 | 3/2003 | Chang et al. | |
| 6,994,865 | B2 | 2/2006 | Branham et al. | |
| 7,588,663 | B2 | 9/2009 | Skoog et al. | |
| 7,732,357 | B2 | 6/2010 | Annis et al. | |
| 8,257,553 | B2 | 9/2012 | Zwick et al. | |
| 8,603,297 | B2 | 12/2013 | Zwick et al. | |
| 8,906,816 | B2 * | 12/2014 | Fingal | D21H 27/002 15/104.93 |
| 9,005,395 | B1 * | 4/2015 | Zwick | D21H 23/24 15/104.93 |
| 9,320,395 | B2 * | 4/2016 | Zwick | D21H 23/24 |
| 9,453,304 | B2 * | 9/2016 | Zwick | D21H 17/455 |
| 2002/0081930 | A1 | 6/2002 | Jackson et al. | |
| 2002/0111450 | A1 | 8/2002 | Chang et al. | |
| 2002/0155281 | A1 | 10/2002 | Lang et al. | |
| 2003/0026963 | A1 | 2/2003 | Chang et al. | |
| 2003/0032352 | A1 * | 2/2003 | Chang | A61K 8/0208 442/102 |
| 2003/0045645 | A1 * | 3/2003 | Chang | A61K 8/0208 525/328.7 |

(Continued)

FOREIGN PATENT DOCUMENTS

| | | | | |
|---|---|---|---|---|
| EP | 0608460 | A1 | 8/1994 | |
| JP | 5179548 | A | 7/1993 | |
| JP | 9228214 | A | 9/1997 | |
| JP | 10310960 | A | 11/1998 | |
| JP | 11012909 | A | 1/1999 | |
| JP | 11043854 | A | 2/1999 | |
| JP | 11093055 | A | 4/1999 | |
| SE | WO 2013015735 | A1 * | 1/2013 | D21H 27/002 |

OTHER PUBLICATIONS

Kohlhammer et al., "New airlaid binders", Nonwovens Report International; Sep. 1999; vol. 28, No. 31, pp. 20-22.

Soukupova et al., "Studies on the Properties of Biodegradable Wipes made by the Hydroentanglement Bonding Technique", Textile Research Journal, 2007, vol. 77, No. 5, pp. 301-311.

International Search Report and Written Opinion of International Application No. PCT/1B2015/050622, dated May 20, 2015, 14 pages.

*Primary Examiner* — Jose Fortuna

(74) *Attorney, Agent, or Firm* — Armstrong Teasdale LLP

(57) ABSTRACT

The present disclosure is generally directed to a dispersible moist wipe comprising hydroentangled fibers and a binder composition. The moist wipe demonstrates high initial wet strength while maintaining effective dispersion in an aqueous environment. The moist wipe has potential application as a flushable surface cleaning product and/or a flushable cleansing cloth.

16 Claims, 10 Drawing Sheets

(56) References Cited

U.S. PATENT DOCUMENTS

2003/0055146 A1* 3/2003 Chang ..... C08F 8/44 524/434
2004/0013859 A1 1/2004 Annis et al.
2004/0030080 A1* 2/2004 Chang ..... A61K 8/0208 526/318.44
2004/0055704 A1* 3/2004 Bunyard ..... A61L 15/62 156/305
2004/0058073 A1* 3/2004 Bunyard ..... A61K 8/0208 427/337
2004/0058600 A1* 3/2004 Bunyard ..... A61K 8/0208 442/59
2004/0058606 A1* 3/2004 Branham ..... A61K 8/0208 442/327
2004/0062791 A1* 4/2004 Branham ..... D04H 1/58 424/443
2004/0063888 A1* 4/2004 Bunyard ..... C08F 220/34 526/310
2004/0111817 A1* 6/2004 Chen ..... A47L 13/16 15/104.94
2005/0087317 A1 4/2005 Rydell
2005/0129897 A1* 6/2005 Zhou ..... A47K 7/02 428/43
2005/0136779 A1* 6/2005 Stralin ..... D21H 21/18 442/408
2005/0266759 A1 12/2005 Baer et al.
2006/0147505 A1 7/2006 Tanzer et al.
2007/0060003 A1 3/2007 Ellis et al.
2007/0141936 A1 6/2007 Bunyard et al.
2008/0000602 A1 1/2008 Dyer et al.
2008/0017339 A1* 1/2008 Zhang ..... D21H 23/24 15/104.93
2008/0268205 A1 10/2008 Vogel et al.
2009/0229776 A1* 9/2009 Zhang ..... D21H 21/20 162/164.6
2011/0290437 A1* 12/2011 Vogel ..... 442/149
2011/0293931 A1 12/2011 Vogel et al.
2012/0080157 A1* 4/2012 Rosencrance ..... D21H 21/20 162/164.6
2012/0090112 A1 4/2012 Carrier et al.
2012/0160436 A1* 6/2012 Zwick ..... C11D 3/046 162/158
2012/0297560 A1 11/2012 Zwick et al.
2014/0090217 A1 4/2014 Jonsson et al.
2014/0170402 A1 6/2014 Knowlson et al.
2014/0173841 A1 6/2014 Hurley et al.
2014/0189970 A1* 7/2014 Fingal ..... D21H 27/001 162/158
2015/0118403 A1* 4/2015 Zwick ..... D04H 1/495 427/372.2
2015/0118466 A1* 4/2015 Zwick ..... D04H 1/04 428/219
2015/0216374 A1* 8/2015 Zwick ..... D21H 23/24 428/338
2016/0017542 A1* 1/2016 Bradley ..... D21H 11/04 162/111
2016/0201268 A1* 7/2016 Zwick ..... D21H 23/24 428/342
2016/0355979 A1* 12/2016 Zwick ..... D21H 21/20

* cited by examiner

DISPERSIBLE HYDROENTANGLED BASESHEET WITH TRIGGERABLE BINDER

CROSS REFERENCE TO RELATED APPLICATIONS

This application is a divisional application of U.S. patent application Ser. No. 15/075,638 entitled DISPERSIBLE HYDROENTANGLED BASESHEET WITH TRIGGERABLE BINDER, filed Mar. 21, 2016 (now U.S. Pat. No. 9,453,304), which is a divisional application of U.S. patent application Ser. No. 14/643,545 entitled DISPERSIBLE HYDROENTANGLED BASESHEET WITH TRIGGERABLE BINDER, filed Mar. 10, 2015 (now U.S. Pat. No. 9,320,395), which is a divisional application of U.S. patent application Ser. No. 14/169,859 entitled DISPERSIBLE HYDROENTANGLED BASESHEET WITH TRIGGERABLE BINDER, filed Jan. 31, 2014 (now U.S. Pat. No. 9,005,395). The disclosure of each of these applications is fully incorporated herein by reference.

FIELD

The field of the disclosure relates generally to moist wipes and more specifically to dispersible moist wipes adapted to be flushed down a toilet and methods of making such moist wipes. The dispersible moist wipes comprise hydroentangled fibers and a binder composition. The moist wipes demonstrate high initial wet strength while maintaining effective dispersion in an aqueous environment.

BACKGROUND

Dispersible moist wipes are generally intended to be used and then flushed down a toilet. Accordingly, it is desirable for such flushable moist wipes to have an in-use strength sufficient to withstand a user's extraction of the wipe from a dispenser and the user's wiping activity, but then relatively quickly breakdown and disperse in household and municipal sanitization systems, such as sewer or septic systems. Some municipalities may define "flushable" through various regulations. Flushable moist wipes must meet these regulations to allow for compatibility with home plumbing fixtures and drain lines, as well as the disposal of the product in onsite and municipal wastewater treatment systems.

One challenge for some known flushable moist wipes is that it takes a relatively longer time for them to break down in a sanitation system as compared to conventional, dry toilet tissue thereby creating a risk of blockage in toilets, drainage pipes, and water conveyance and treatment systems. Dry toilet tissue typically exhibits lower post-use strength upon exposure to tap water, whereas some known flushable moist wipes require a relatively long period of time and/or significant agitation within tap water for their post-use strength to decrease sufficiently to allow them to disperse. Attempts to address this issue, such as making the wipes to disperse more quickly, may reduce the in-use strength of the flushable moist wipes below a minimum level deemed acceptable by users.

Some known flushable moist wipes are formed by entangling fibers in a nonwoven web. A nonwoven web is a structure of individual fibers which are interlaid to form a matrix, but not in an identifiable repeating manner. While the entangled fibers themselves may disperse relatively quickly, known wipes often require additional structure to improve in-use strength. For example, some known wipes use a net having fibers entangled therewith. The net provides additional cohesion to the entangled fibers for increased in-use strength. However, such nets do not disperse upon flushing.

Some known moist wipes obtain increased in-use strength by entangling bi-component fibers in the nonwoven web. After entanglement, the bi-component fibers are thermoplastically bonded together to increase in-use strength. However, the thermoplastically bonded fibers negatively impact the ability of the moist wipe to disperse in a sanitization system in a timely fashion. That is, the bi-component fibers and thus the moist wipe containing the bi-component fibers often do not readily disperse when flushed down a toilet.

Other known flushable moist wipes add a triggerable salt-sensitive binder. The binder attaches to the cellulose fibers of the wipes in a formulation containing a salt solution, yielding a relatively high in-use strength. When the used moist wipes are exposed to the water of the toilet and/or sewer system, the binder swells thereby allowing and potentially even assisting in the wipes falling apart, which allows for relatively rapid dispersal of the wipes. However, such binders are relatively costly.

Still other known flushable moist wipes incorporate a relatively high quantity of synthetic fibers to increase the in-use strength. However, the ability of such wipes to disperse in a timely fashion is correspondingly reduced. In addition, a higher cost of synthetic fibers relative to natural fibers causes a corresponding increase in cost of such known moist wipes.

Thus, there is a need to provide a wet wipe that provides an in-use strength expected by consumers, disperses sufficiently quickly to be flushable without creating potential problems for household and municipal sanitation systems, and is cost-effective to produce.

SUMMARY OF THE DISCLOSURE

In one embodiment of the present disclosure, a dispersible moist wipe generally comprises a plurality of entangled fibers and about 0.5 grams per square meter (gsm) to about 5 gsm of an ion-triggerable binder composition. The wipe has a geometric mean tensile (GMT) wet strength of at least about 300 grams per inch (g/in), a GMT soak wet strength of less than about 180 g/in, and a CD stretch percent greater than about 40%.

In another suitable embodiment, a dispersible moist wipe generally comprises a plurality of entangled fibers and about 0.5 grams per square meter (gsm) to about 5 gsm of an ion-triggerable binder composition. The wipe has a geometric mean tensile (GMT) wet strength of at least about 300 grams per inch (g/in), a GMT soak wet strength of less than about 180 g/in, and a wet density of less than about 0.115 g/ccm.

In yet another embodiment, a dispersible moist wipe generally comprises entangled fibers comprising regenerated fibers in an amount of about 5 to about 30 percent by weight and natural fibers in an amount of about 70 to about 95 percent by weight, and a binder composition, wherein the binder composition comprises a composition having the structure:

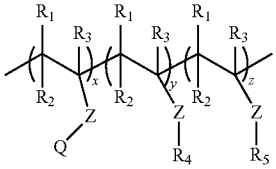

wherein x=1 to about 15 mole percent; y=about 60 to about 99 mole percent; and z=0 to about 30 mole percent; Q is selected from $C_1$-$C_4$ alkyl ammonium, quaternary $C_1$-$C_4$ alkyl ammonium and benzyl ammonium; Z is selected from —O—, —COO—, —OOC—, —CONH—, and —NHCO—, $R_1$, $R_2$, $R_3$ are independently selected from hydrogen and methyl; $R_4$ is $C_1$-$C_4$ alkyl; $R_5$ is selected from hydrogen, methyl, ethyl, butyl, ethylhexyl, decyl, dodecyl, hydroxyethyl, hydroxypropyl, polyoxyethylene, and polyoxypropylene.

In still another embodiment, a dispersible moist wipe generally comprises entangled fibers comprising regenerated fibers in an amount of about 5 to about 30 percent by weight and natural fibers in an amount of about 70 to about 95 percent by weight, and a binder composition, wherein the binder composition comprises the polymerization product of a vinyl-functional cationic monomer and one or more hydrophobic vinyl monomers with alkyl side chains of 1 to 4 carbon atoms.

In another embodiment, a dispersible moist wipe generally comprises entangled fibers and a binder composition, wherein the binder composition comprises a composition having the structure:

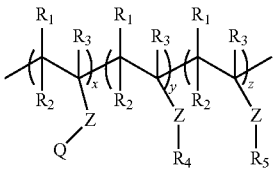

wherein x=1 to about 15 mole percent; y=about 60 to about 99 mole percent; and z=0 to about 30 mole percent; Q is selected from $C_1$-$C_4$ alkyl ammonium, quaternary $C_1$-$C_4$ alkyl ammonium and benzyl ammonium; Z is selected from —O—, —COO—, —OOC—, —CONH—, and —NHCO—; $R_1$, $R_2$, $R_3$ are independently selected from hydrogen and methyl; $R_4$ is $C_1$-$C_4$ alkyl; $R_5$ is selected from hydrogen, methyl, ethyl, butyl, ethylhexyl, decyl, dodecyl, hydroxyethyl, hydroxypropyl, polyoxyethylene, and polyoxypropylene.

In yet another embodiment, a dispersible moist wipe comprises entangled fibers and a binder composition, wherein the binder composition comprises the polymerization product of a vinyl-functional cationic monomer and one or more hydrophobic vinyl monomers with alkyl side chains of 1 to 4 carbon atoms.

In yet another embodiment, a dispersible moist wipe has a geometric mean tensile (GMT) wet strength of at least about 300 grams per inch (g/in), a GMT soak wet strength of less than about 180 g/in, and a CD stretch percent greater than about 40%.

DETAILED DESCRIPTION OF THE DISCLOSURE

Figure 1:
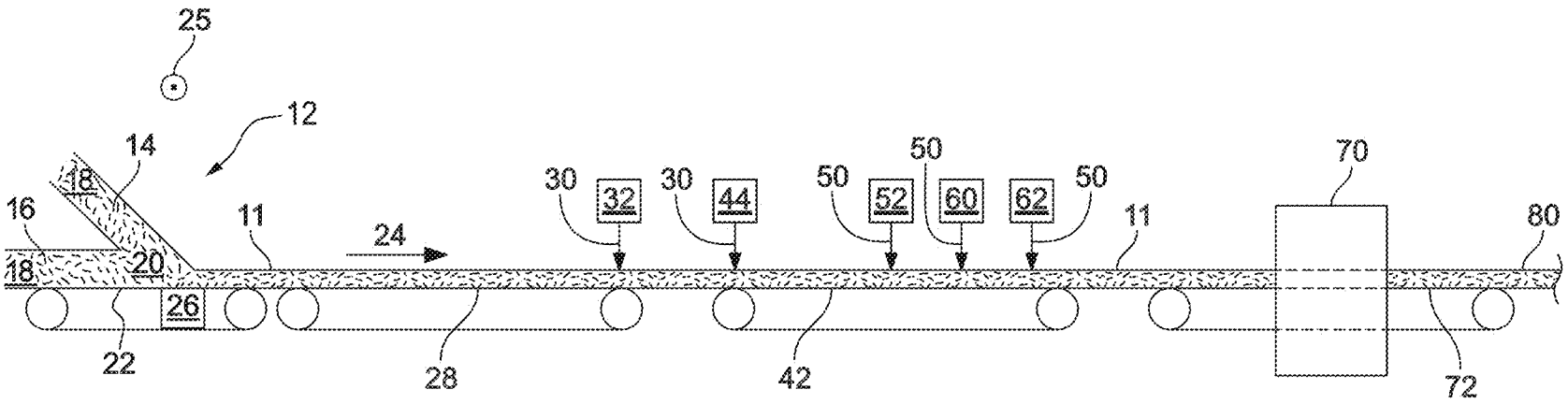
FIG. 1 is a schematic of one suitable embodiment of an apparatus for making dispersible moist wipes.

The dispersible moist wipes of the current disclosure have sufficient strength to withstand packaging and consumer use. They also disperse sufficiently quickly to be flushable without creating potential problems for household and municipal sanitation systems. Additionally, they may be comprised of materials that are suitably cost-effective.

The present disclosure is thus directed to, in part, a hydroentangled basesheet with low binder add-on that demonstrates high initial wet strength and rapid loss in wet strength under static soak. This combination has the surprising effect of a high initial strength and effective dispersion and can be used as, for example, a flushable surface cleaning product or a flushable cleansing cloth.

With respect to flushable cleansing cloths used for perineal hygiene, the cloths should be: (1) moist to clean effectively; (2) strong enough when moist to wipe without ripping or poking through; and, (3) dispersible enough to break up in the sewer or septic system. Generally, sheets that are strong enough for wiping will not break up after use. Other sheets that are strong in a salt solution lose strength over time in relatively free ion water of the toilet and sewer system, but these sheets have several drawbacks. First, the wet strength of the sheet is limited by how much binder is applied. There is only one mechanism giving strength to the sheet (i.e., the binder) so without a lot of binder to form a lot of bonds, the strength is pretty low. Second, the binder can be expensive and a lot of it is required. Third, with a lot of binder the fibers are closely bonded so the stretch is relatively low. Fourth, binder requirements can be reduced by using a denser starting sheet, but the higher density sheets tend to feel more papery and have even less stretch than the high binder sheets. Thus, a need exists for a sheet that has more strength without using a lot of binder, or a dense low stretch sheet.

Other conventional technologies in the industry do not require a binder, but, rather, rely on strength from entangled fibers and bi-component fibers thermoplastically bonded together. These technologies have several drawbacks as well: (1) the sheets require bi-component fibers to generate enough strength to be acceptable as a wipe, but the fibers used reduce dispersibility and render the sheets not completely biodegradable; (2) the sheets are only marginally dispersible and this cannot be fixed without weakening the sheets; and, (3) the sheets don't lose any strength unless they are agitated, which means the sheets will stay strong in the static environment of most sewers, drainlines and septic systems. Thus, a need exists for a sheet that enables strength decay without agitation, but that does not require a lot of expensive binder.

In accordance with the present disclosure, the inventors have surprisingly found a solution for a moist wipe with greater wet strength than conventional wipes by hitting a wetlaid sheet with hydroentangling jets and then applying a relatively small amount of a binder composition to the sheet. Thus, in one embodiment of the present disclosure, a method for making a dispersible moist wipe is disclosed, the method comprising applying hydroentangling jets to a wetlaid sheet, adding a binder composition to the sheet, drying the sheet, and then curing the sheet. By using a combination of hydroentangled fibers and a relatively small amount of binder, the inventors were able to increase the strength of moist wipes while still maintaining a good dispersibility.

In some embodiments of the present disclosure, the dispersible moist wipe comprises from about 0.5 grams per square meter (gsm) to about 5 gsm of the binder composition. In preferred embodiments of the present disclosure, the dispersible moist wipe comprises from about 1 gsm to about 4 gsm, from about 1.2 gsm to about 2.6 gsm, or from about 1.28 gsm to about 2.2 gsm of the binder composition. In other preferred embodiments of the present disclosure, the dispersible moist wipe comprises about 1.28 gsm, about 1.8 gsm, about 2.2 gsm, about 2.6 gsm, or about 4 gsm of the binder composition.

In some embodiments of the present disclosure, the combination of the hydroentangled fibers and the binder composition gives the moist wipe a geometric mean tensile (GMT) wet strength of at least about 300 grams per inch (g/in). In other embodiments of the present disclosure, the moist wipe has a GMT wet strength of at least about 500 g/in, at least about 600 g/in, at least about 700 g/in, or at least about 800 g/in. In some preferred embodiments of the present disclosure, the moist wipe has a GMT wet strength of from about 500 g/in to about 900 g/in.

In other embodiments of the present disclosure, the combination of the hydroentangled fibers and the binder composition gives the moist wipe a GMT soak wet strength of less than about 180 g/in. In other embodiments of the present disclosure, the moist wipe has a GMT soak strength of less than about 175 g/in, less than about 170 g/in, less than about 165 g/in, less than about 160 g/in, less than about 155 g/in, less than about 150 g/in, less than about 145 g/in, or less than about 140 g/in. In some preferred embodiments of the present disclosure, the moist wipe has a GMT soak wet strength of from about 130 g/in to about 175 g/in.

In some preferred embodiments of the present disclosure, the combination of hydroentangled fibers and the binder composition gives the moist wipe a GMT wet strength of from about 300 g/in to about 900 g/in and a GMT soak wet strength of from about 130 g/in to about 175 g/in.

Another surprising benefit from the combination of the hydroentangled fibers and binder compositions of the present disclosure is the ability to have a moist wipe with good strength, good dispersibility and good stretchability. In some embodiments of the present disclosure, the moist wipe has a CD stretch % of greater than about 40%. In some preferred embodiments, the moist wipe has a CD stretch % of from about 45% to about 55%, or from about 47% to about 49%.

Yet another surprising benefit from the combination of the hydroentangled fibers and binder compositions of the present disclosure is having a moist wipe with good strength, good dispersibility and a low density. In some embodiments of the present disclosure, the moist wipe has a wet density of less than about 0.115 g/ccm. In some preferred embodiments of the present disclosure, the moist wipe has a wet density of from about 0.100 g/ccm to about 0.115 g/ccm, or from about 0.110 g/ccm to about 0.112 g/ccm.

As noted elsewhere throughout this disclosure, the combination of hydroentangled fibers and binder compositions of the present disclosure create a wipe with good dispersibility. The dispersibility of the dispersible moist wipes can be measured using a slosh-box test, as detailed elsewhere in this disclosure. In some embodiments of the present disclosure, the moist wipe of the present disclosure has a slosh-box break-up time of less than about 155 minutes. In other embodiments, the moist wipe has a slosh-box break-up time of from about 80 minutes to about 155 minutes. In some preferred embodiments of the present disclosure, the moist wipe has a GMT wet strength of at least about 300 g/in, a GMT soak wet strength of less than about 180 g/in and a slosh-box break-up time of less than about 155 minutes. In other embodiments of the present disclosure, the moist wipe has a GMT wet strength of from about 500 g/in to about 900 g/in, a GMT soak wet strength of from about 130 g/in to about 175 g/in and a slosh-box break-up time of from about 80 minutes to about 155 minutes.

Hydroentangled Fibers

One suitable embodiment of an apparatus, indicated generally at 10, for making a dispersible nonwoven sheet 80 for making dispersible moist wipes is shown in FIG. 1. The apparatus 10 is configured to form a nonwoven fibrous web 11 comprising a mixture of natural cellulose fibers 14 and regenerated cellulose fibers 16. The natural cellulose fibers 14 are cellulosic fibers derived from woody or non-woody plants including, but not limited to, southern softwood kraft, northern softwood kraft, softwood sulfite pulp, cotton, cotton linters, bamboo, and the like. In some embodiments, the natural fibers 14 have a length-weighted average fiber length greater than about 1 millimeter. Furthermore, the natural fibers 14 may have a length-weighted average fiber length greater than about 2 millimeters. In other suitable embodiments, the natural fibers 14 are short fibers having a fiber length between about 0.5 millimeters and about 1.5 millimeters.

The regenerated fibers 16 are man-made filaments obtained by extruding or otherwise treating regenerated or modified cellulosic materials from woody or non-woody plants, as is known in the art. For example, but not by way of limitation, the regenerated fibers 16 may include one or more of lyocell, rayon, and the like. In some embodiments, the regenerated fibers 16 have a fiber length in the range of about 3 to about 60 millimeters. In some embodiments, the regenerated fibers 16 have a fiber length in the range of about 4 millimeters to about 15 millimeters. Furthermore, the regenerated fibers 16 may have a fiber length in the range of about 6 to about 12 millimeters. In other embodiments, the regenerated fibers 16 have a fiber length in the range of about 30 to about 60 millimeters. Additionally, in some embodiments, the regenerated fibers 16 may have a fineness in the range of about 0.5 to about 3 denier. Moreover, the fineness may be in the range of about 1.2 to about 2.2 denier.

In some other suitable embodiments, it is contemplated to use synthetic fibers in combination with, or as a substitute for, the regenerated fibers 16. For example, but not by way of limitation, the synthetic fibers may include one or more of nylon, polyethylene terephthalate (PET), and the like. In some embodiments, the synthetic fibers have a fiber length in the range of about 3 to about 20 millimeters. Furthermore, the synthetic fibers may have a fiber length in the range of about 6 to about 12 millimeters.

As illustrated in FIG. 1, the natural fibers 14 and regenerated fibers 16 are dispersed in a liquid suspension 20 to a headbox 12. A liquid medium 18 used to form the liquid suspension 20 may be any liquid medium known in the art that is compatible with the process as described herein, for example, water. In some embodiments, a consistency of the liquid suspension 20 is in the range of about 0.02 to about 0.3 percent fiber by weight. Moreover, the consistency of the liquid suspension 20 may be in the range of about 0.03 to about 0.05 percent fiber by weight. In one suitable embodiment, the consistency of the liquid suspension 20 after the natural fibers 14 and regenerated fibers 16 are added is about 0.03 percent fiber by weight. A relatively low consistency of the liquid suspension 20 at the headbox 12 is believed to enhance a mixing of the natural fibers 14 and regenerated fibers 16 and, therefore, enhances a formation quality of the nonwoven web 11.

In one suitable embodiment, of the total weight of fibers present in the liquid suspension 20, a ratio of natural fibers 14 and regenerated fibers 16 is about 70 to about 95 percent by weight natural fibers 14 and about 5 to about 30 percent by weight regenerated fibers 16. For example, of the total weight of fibers present in the liquid suspension 20, the natural fibers 14 may be 85 percent of the total weight and the regenerated fibers 16 may be 15 percent of the total weight.

The headbox 12 is configured to deposit the liquid suspension 20 onto a foraminous forming wire 22, which retains the fibers to form the nonwoven fibrous web 11. In an embodiment, the headbox 12 is configured to operate in a low-consistency mode as is described in U.S. Pat. No. 7,588,663, issued to Skoog et al. and assigned to Kimberly-Clark Worldwide, Inc., which is herein incorporated by reference. In another suitable embodiment, the headbox 12 is any headbox design that enables forming the nonwoven tissue web 11 such that it has a Formation Number of at least 18. The forming wire 22 carries the web 11 in a direction of travel 24. An axis of the nonwoven tissue web 11 aligned with the direction of travel 24 may hereinafter be referred to as "machine direction," and an axis in the same plane which is perpendicular to the machine direction may hereinafter be referred to as "cross-machine direction" 25. In some embodiments, the apparatus 10 is configured to draw a portion of the remaining liquid dispersing medium 18 out of the wet nonwoven tissue web 11 as the web 11 travels along the forming wire 22, such as by the operation of a vacuum box 26.

The apparatus 10 also may be configured to transfer the nonwoven tissue web 11 from the forming wire 22 to a transfer wire 28. In some embodiments, the transfer wire 28 carries the nonwoven web in the machine direction 24 under a first plurality of jets 30. The first plurality of jets 30 may be produced by a first manifold 32 with at least one row of first orifices 34 spaced apart along the cross-machine direction 25. The first manifold 32 is configured to supply a liquid, such as water, at a first pressure to the first orifices 34 to produce a columnar jet 30 at each first orifice 34. In some embodiments, the first pressure is in the range of about 20 to about 125 bars. In one suitable embodiment, the first pressure is about 35 bars.

In some embodiments, each first orifice 34 is of circular shape with a diameter in the range of about 80 to about 200 micrometers, in some embodiments from about 90 to about 150 micrometers. In one suitable embodiment, for example, each first orifice 34 has a diameter of about 120 micrometers. In addition, each first orifice 34 is spaced apart from an adjacent first orifice 34 by a first distance 36 along the cross-machine direction 25. Contrary to what is known in the art, in some embodiments the first distance 36 is such that a first region 38 of fibers of the nonwoven tissue web 11 displaced by each jet of the first plurality of jets 30 does not overlap substantially with a second region 40 of fibers displaced by the adjacent one of the first plurality of jets 30, as illustrated schematically in FIG. 2. Instead, the fibers in each of the first region 38 and the second region 40 are substantially displaced in a direction along an axis 46 perpendicular to the plane of nonwoven web 11, but are not significantly hydroentangled with laterally adjacent fibers. In some embodiments, the first distance 36 is in the range of about 1200 to about 2400 micrometers. In an embodiment, the first distance 36 is about 1800 micrometers. In alternative embodiments, the first plurality of jets 30 may be produced by first orifices 34 having any shape, or any jet nozzle and pressurization arrangement, that is configured to produce a row of columnar jets 30 spaced apart along the cross-machine direction 25 in like fashion.

Additional ones of the first plurality of jets 30 optionally may be produced by additional manifolds, such as a second manifold 44 shown in the exemplary embodiment of FIG. 1, spaced apart from the first manifold 32 in the direction of machine travel. A foraminous support fabric 42 is configured such that the nonwoven tissue web 11 may be transferred from the transfer wire 28 to the support fabric 42. In an embodiment, the support fabric 42 carries the nonwoven tissue web 11 in the machine direction 24 under the second manifold 44. It should be understood that the number and placement of transport wires or transport fabrics, such as the forming wire 22, the transport wire 28, and the support fabric 42, may be varied in other embodiments. For example, but not by way of limitation, the first manifold 32 may be located to treat the nonwoven tissue web 11 while it is carried on the support fabric 42, rather than on the transfer wire 28, or conversely the second manifold 44 may be located to treat the nonwoven tissue web 11 while it is carried on the transfer wire 28, rather than on the support fabric 42. For another example, one of the forming wire 22, the transport wire 28, and the support fabric 42 may be combined with another in a single wire or fabric, or any one may be implemented as a series of cooperating wires and transport fabrics rather than as a single wire or transport fabric.

Figure 2:
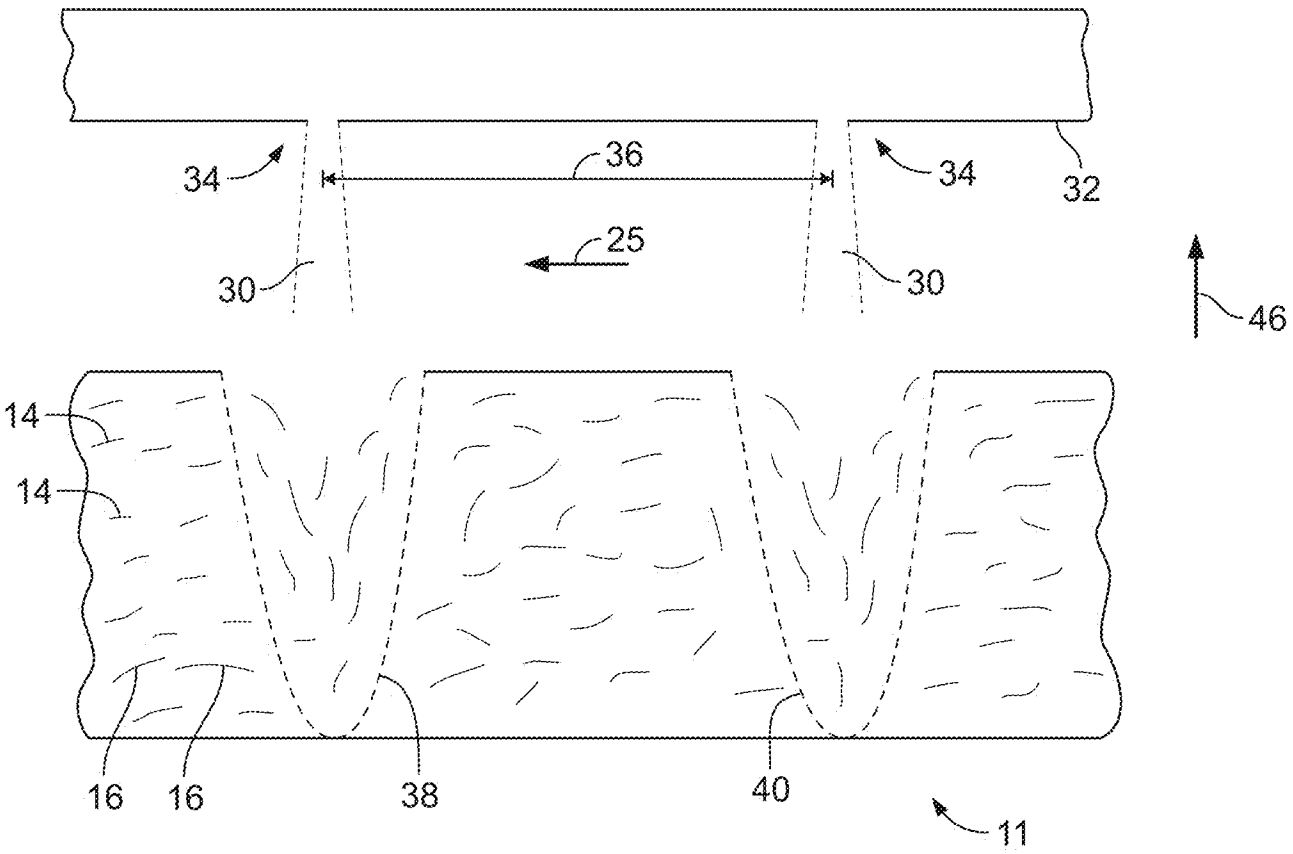
FIG. 2 is a schematic of a nonwoven web at one location within the apparatus of FIG. 1.

In some embodiments, the second manifold 44, like the first manifold 32, includes at least one row of first orifices 34 spaced apart along the cross-machine direction 25. The second manifold 44 is configured to supply a liquid, such as water, at a second pressure to the first orifices 34 to produce a columnar jet 30 at each first orifice 34. In some embodiments, the second pressure is in the range of about 20 to about 125 bars. In an embodiment, the second pressure is about 75 bars. Moreover, in some embodiments, each first orifice 34 is of circular shape, and each first orifice 34 is spaced apart from an adjacent first orifice 34 by a first distance 36 along the cross-machine direction 25, as shown in FIG. 2 for the first manifold 32. In alternative embodiments, the second manifold 44 may be configured in any other fashion such that a first region of fibers of nonwoven tissue web 11 displaced by each jet of the first plurality of jets 30 does not overlap substantially with a second region of fibers displaced by the adjacent one of the first plurality of jets 30.

With reference again to FIG. 1, the support fabric 42 carries the nonwoven web 11 in the machine direction 24 under a second plurality of jets 50. The second plurality of jets 50 may be produced by a third manifold 52 with at least one row of second orifices 54 spaced apart along the cross-machine direction 25. The third manifold 52 is configured to supply a liquid, such as water, at a third pressure to the second orifices 54 to produce a columnar jet 50 at each third orifice 54. In some embodiments, the third pressure is in the range of about 20 to about 120 bars. Further, the third pressure may be in the range of about 40 to about 90 bars.

Figure 3:
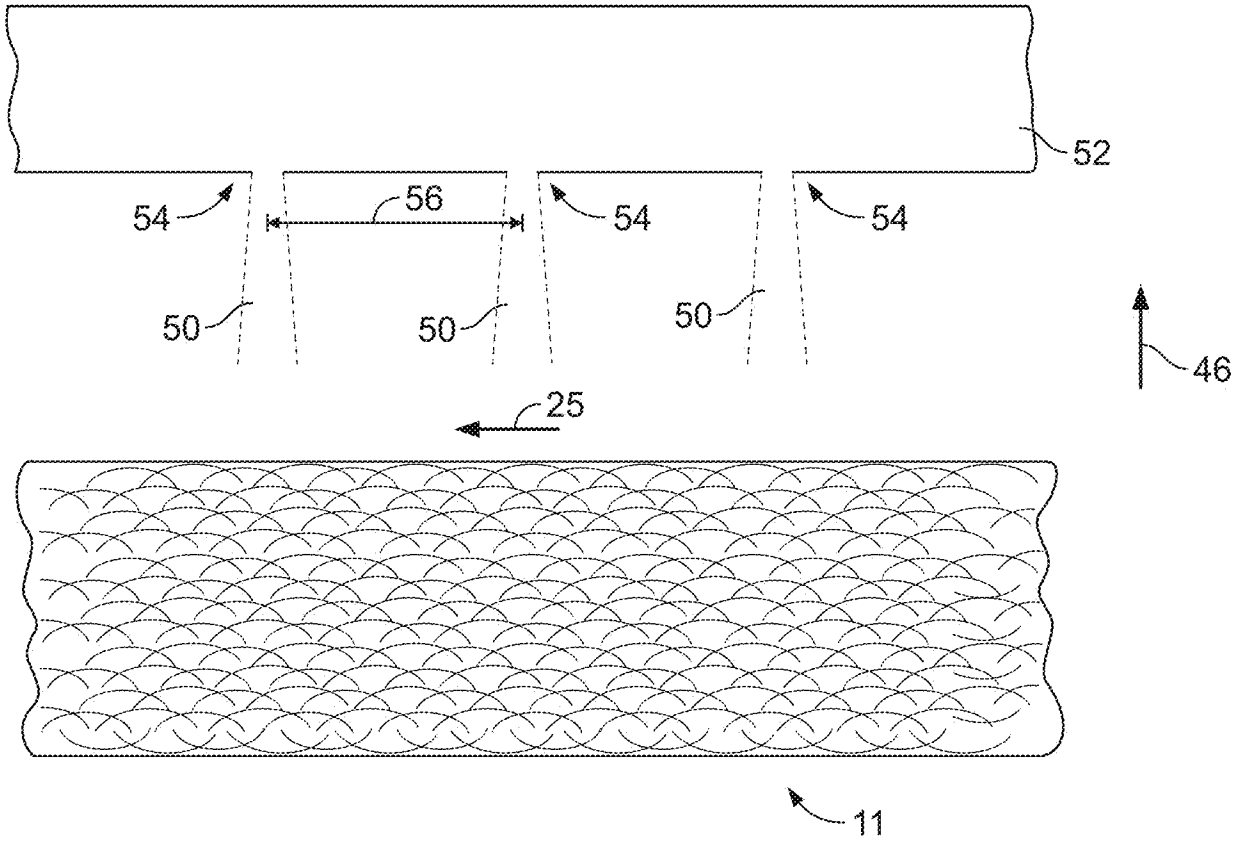
FIG. 3 is a schematic of a nonwoven web at another location within the apparatus of FIG. 1.

In some embodiments, each second orifice 54 is of circular shape with a diameter in the range of about 90 to about 150 micrometers. Moreover, each second orifice 54 may have a diameter of about 120 micrometers. In addition, each second orifice 54 is spaced apart from an adjacent second orifice 54 by a second distance 56 along the cross-machine direction 25, as illustrated in FIG. 3, and the second distance 56 is such that the fibers of the nonwoven tissue web 11 become substantially hydroentangled. In some embodiments, the second distance 56 is in the range of about 400 to about 1000 micrometers. Further, the second distance 56 may be in the range of about 500 to about 700 micrometers. In an embodiment, the second distance 56 is about 600 micrometers. In alternative embodiments, the second plurality of jets 50 may be produced by second orifices 54 having any shape, or any jet nozzle and pressurization arrangement, that is configured to produce a row of columnar jets 50 spaced apart along the cross-machine direction 25 in like fashion.

Additional ones of the second plurality of jets 50 optionally may be produced by additional manifolds, such as a fourth manifold 60 and a fifth manifold 62 shown in the exemplary embodiment of FIG. 1. Each of the fourth manifold 60 and the fifth manifold 62 have at least one row of second orifices 54 spaced apart along the cross-machine direction 25. In an embodiment, the fourth manifold 60 and the fifth manifold 62 each are configured to supply a liquid, such as water, at the third pressure (that is, the pressure at third manifold 52) to the second orifices 54 to produce a columnar jet 50 at each third orifice 54. In alternative embodiments, each of the fourth manifold 60 and the fifth manifold 62 may supply the liquid at a pressure other than the third pressure. Moreover, in some embodiments, each second orifice 54 is of circular shape with a diameter in the range of about 90 to about 150 micrometers, and each second orifice 54 is spaced apart from an adjacent second orifice 54 by a second distance 56 along the cross-machine direction 25, as with third manifold 52. In alternative embodiments, the fourth manifold 60 and the fifth manifold 62 each may be configured in any other fashion such as to produce jets 50 that cause the fibers of nonwoven tissue web 11 to become substantially hydroentangled.

It should be recognized that, although the embodiment shown in FIG. 1 has two pre-entangling manifolds and three hydroentangling manifolds, any number of additional pre-entangling manifolds and/or hydroentangling manifolds may be used. In particular, each of the forming wire 22, the transfer wire 28, and the support fabric 42 carry the nonwoven tissue web 11 in the direction of machine travel at a respective speed, and as those respective speeds are increased, additional manifolds may be necessary to impart a desired hydroentangling energy to the nonwoven web 11.

The apparatus 10 also may be configured to remove a desired portion of the remaining fluid, for example water, from the nonwoven tissue web 11 after the hydroentanglement process to produce a dispersible nonwoven sheet 80. In some embodiments, the hydroentangled nonwoven web 11 is transferred from the support fabric 42 to a through-drying fabric 72, which carries the nonwoven web 11 through a through-air dryer 70. In some embodiments, the through-drying fabric 72 is a coarse, highly permeable fabric. The through-air dryer 70 is configured to pass hot air through the nonwoven tissue web 11 to remove a desired amount of fluid. Thus, the through-air dryer 70 provides a relatively non-compressive method of drying the nonwoven tissue web 11 to produce the dispersible nonwoven sheet 80. In alternative embodiments, other methods may be used as a substitute for, or in conjunction with, the through-air dryer 70 to remove a desired amount of remaining fluid from the nonwoven tissue web 11 to form the dispersible nonwoven sheet 80. For example, in some embodiments the through-air dryer may be used without a fabric. In other suitable embodiments of the disclosure, other drying systems known in the art (i.e., other than a through-air dryer system, e.g., drying cans, IR, ovens) may be used so long as they do not deviate from the scope of this disclosure. Furthermore, in some suitable embodiments, the dispersible nonwoven sheet 80 may be wound on a reel (not shown) to facilitate storage and/or transport prior to further processing. The dispersible nonwoven sheet 80 may then be processed as desired, for example, infused with a wetting composition including any combination of water, emollients, surfactants, fragrances, preservatives, organic or inorganic acids, chelating agents, pH buffers, and the like, and cut, folded and packaged as a dispersible moist wipe.

Figure 7:
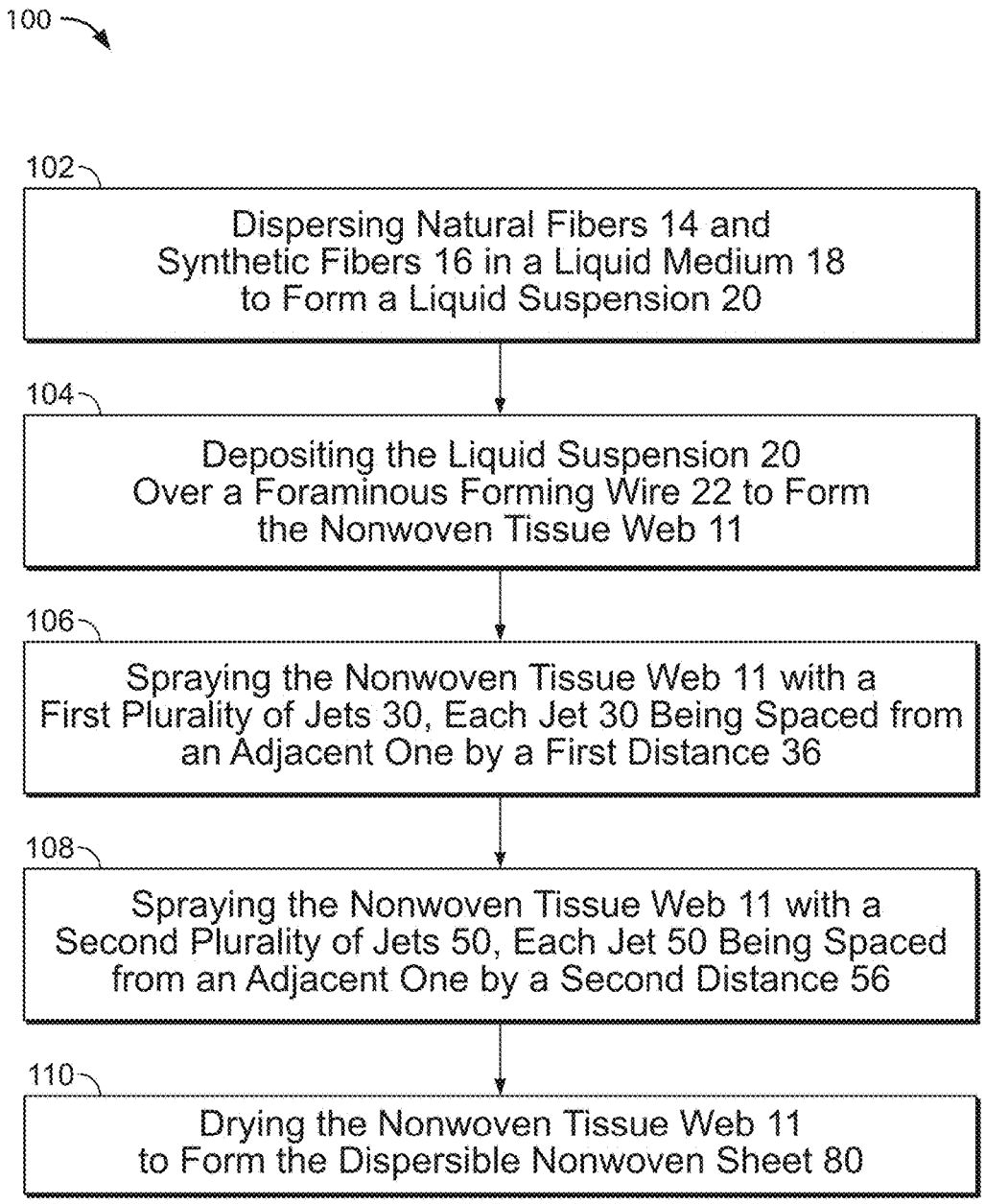
FIG. 7 is a flow chart of an embodiment of a process for making a moist dispersible wipe.

A method 100 for making a dispersible nonwoven sheet 80 is illustrated in FIG. 7. The method 100 includes dispersing 102 natural fibers 14 and regenerated fibers 16 in a ratio of about 80 to about 90 percent by weight natural fibers 14 and about 10 to about 20 percent by weight regenerated fibers 16 in a liquid medium 18 to form a liquid suspension 20. It also includes 104 depositing the liquid suspension 20 over a foraminous forming wire 22 to form the nonwoven tissue web 11. The method 100 further includes spraying 106 the nonwoven tissue web 11 with a first plurality of jets 30, each jet 30 being spaced from an adjacent one by a first distance 36. Additionally, the method 100 includes spraying 108 the nonwoven tissue web 11 with a second plurality of jets 50, each jet 50 being spaced from an adjacent one by a second distance 56, wherein the second distance 56 is less than the first distance 36. The method 100 moreover includes drying 110 the nonwoven tissue web 11 to form the dispersible nonwoven sheet 80.

Figure 4:
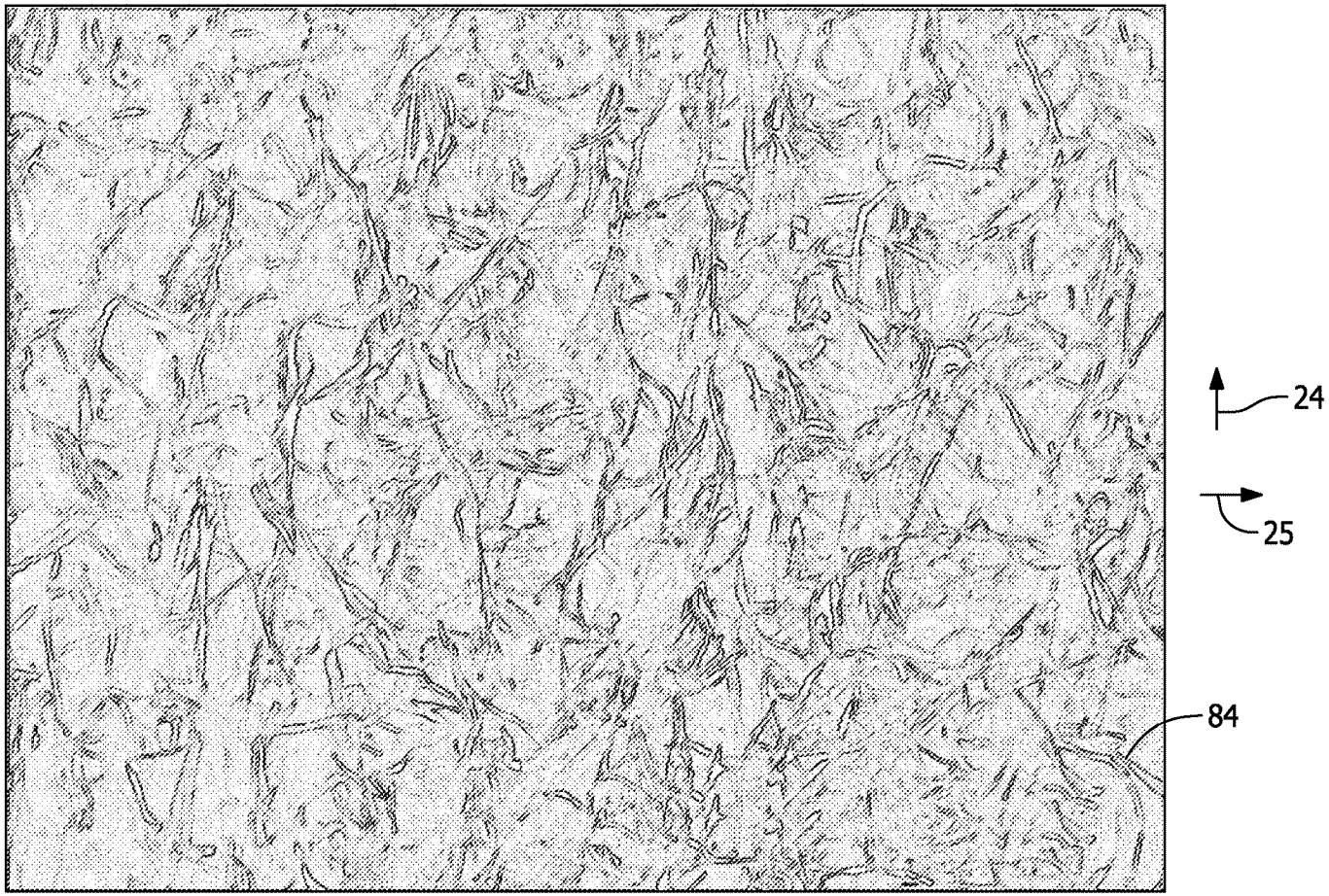
FIG. 4 is a bottom view of one suitable embodiment of a nonwoven web.
Figure 5:
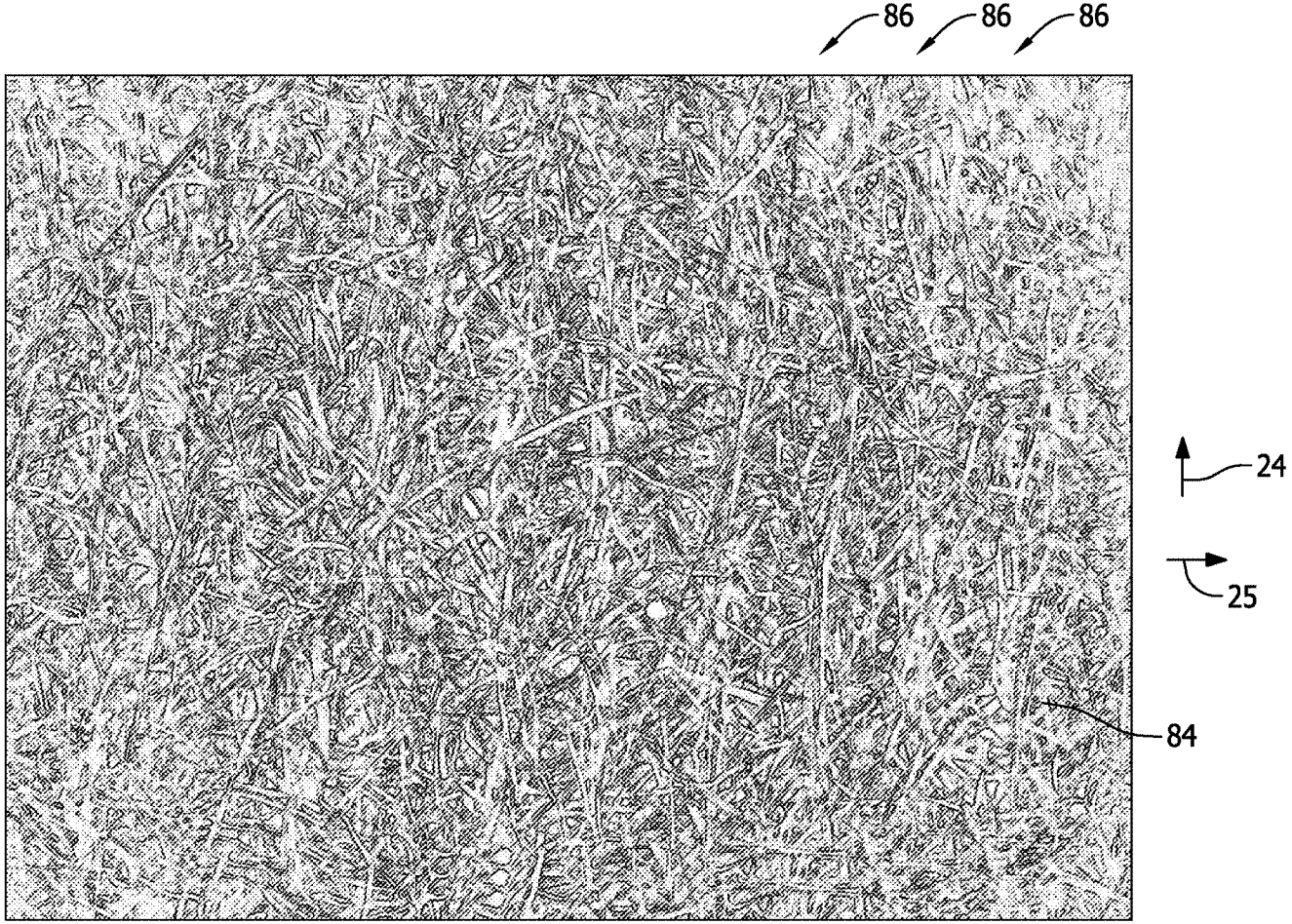
FIG. 5 is a top view of one suitable embodiment of a nonwoven web.
Figure 6:
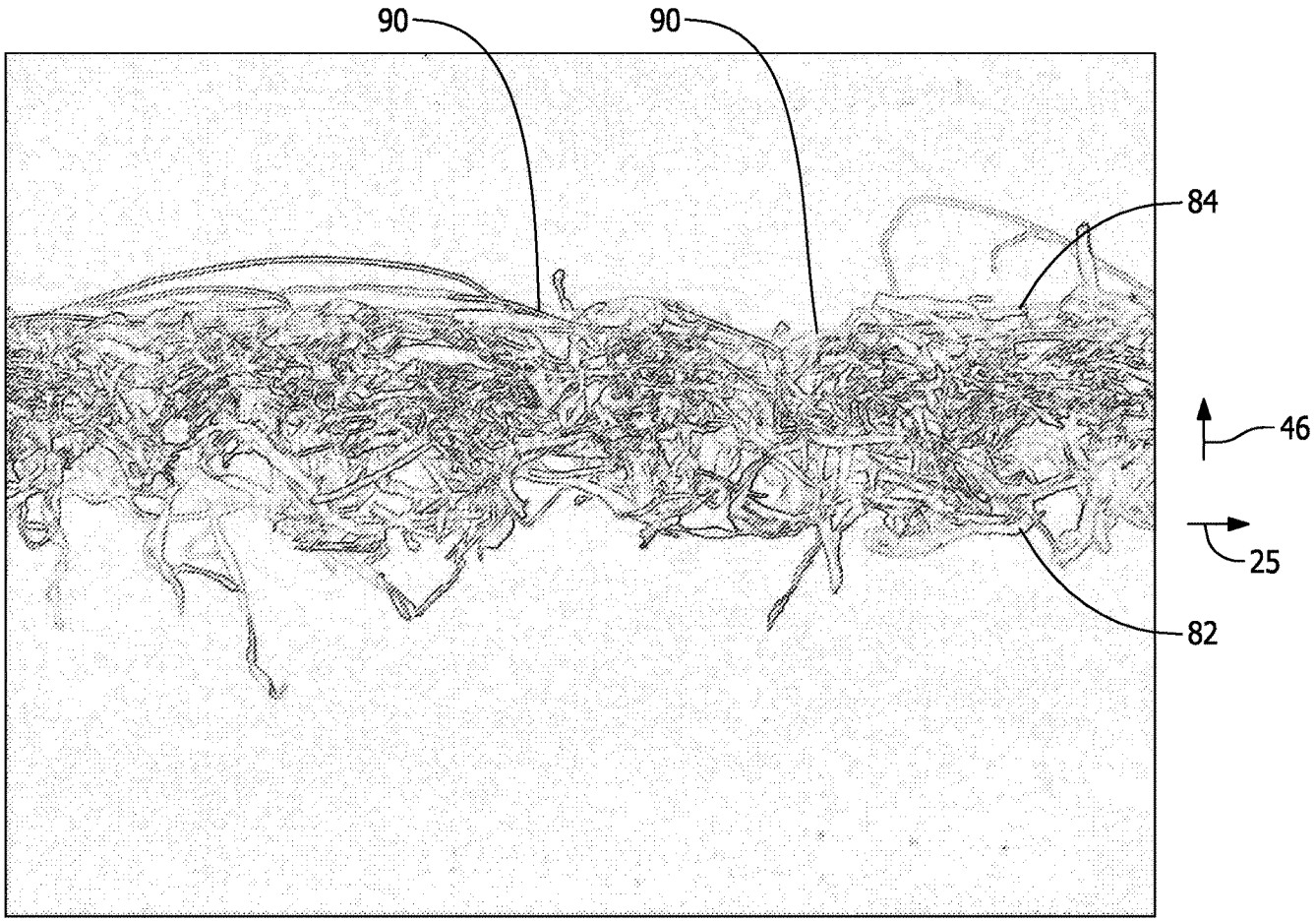
FIG. 6 is a side view of one suitable embodiment of a nonwoven web.

One suitable embodiment of the nonwoven sheet 80 made using the method described above is illustrated in FIG. 4, FIG. 5, and FIG. 6. An enlarged view of a bottom side 82, that is, the side in contact during manufacture with the forming wire 22, the transfer wire 28, and the support fabric 42, of a portion of the nonwoven sheet 80 is shown in FIG. 4. An enlarged view of a top side 84, that is, the side opposite the bottom side 82, of a portion of the nonwoven sheet 80 is shown in FIG. 5. The portion shown in each figure measures approximately 7 millimeters in the cross machine direction 25. As best seen in FIG. 5, the nonwoven sheet 80 includes ribbon-like structures 86 of relatively higher entanglement along the machine direction 24, each ribbon-like structure 86 is spaced apart in the cross-machine direction 25 at a distance approximately equal to the second distance 56 between second orifices 54 of the second plurality of jets 50. As visible in a side view of a portion of the nonwoven sheet 80 in FIG. 6, certain areas 90 of the nonwoven sheet 80 display less fiber entanglement through a thickness of the sheet 80, and more displacement in the direction 46 perpendicular to the plane of the sheet 80.

It is contemplated that in some suitable embodiments of the present disclosure, the fibrous web 11 and/or the sheet 80 can be formed using any suitable method including, for example, an airlaid process or a carding process. It is also contemplated that the fibrous web 11 and/or the sheet 80 can be made using other hydroentangling processes besides those described herein, for example, drum entangling.

Binder Compositions

In one embodiment of the present disclosure, the moist wipe comprises triggerable cationic polymer(s) or polymer compositions. The triggerable, cationic polymer composition can be an ion-sensitive cationic polymer composition. In order to be an effective ion-sensitive or triggerable cationic polymer or cationic polymer formulation suitable for use in flushable or water-dispersible personal care products, the formulations should desirably be (1) functional; i.e., maintain wet strength under controlled conditions and dissolve or disperse in a reasonable period of time in soft or hard water, such as found in toilets and sinks around the world; (2) safe (not toxic); and (3) relatively economical. In addition to the foregoing factors, the ion-sensitive or triggerable formulations when used as a binder composition for a non-woven substrate, such as a wet wipe, desirably should be (4) processable on a commercial basis; i.e., may be applied relatively quickly on a large scale basis, such as by spraying (which thereby requires that the binder composition have a relatively low viscosity at high shear); (5) provide acceptable levels of sheet or substrate wettability; (6) provide reduced levels of sheet stiffness; and (7) reduced tackiness. The wetting composition with which the wet wipes of the present disclosure are treated can provide some of the foregoing advantages, and, in addition, can provide one or more of (8) improved skin care, such as reduced skin irritation or other benefits, (9) improved tactile properties, and (10) promote good cleaning by providing a balance in use between friction and lubricity on the skin (skin glide). The ion-sensitive or triggerable cationic polymers and polymer formulations of the present disclosure and articles made therewith, especially moist wipes comprising particular wetting compositions set forth below, can meet many or all of the above criteria.

Ion-Triggerable Cationic Polymer Compositions

In some embodiments of the present disclosure, the ion-triggerable cationic polymers of the present disclosure are the polymerization product of a vinyl-functional cationic monomer, and one or more hydrophobic vinyl monomers with alkyl side chain sizes of up to 4 carbons long, such as from 1 to 4 carbon atoms. In preferred embodiments, the ion-triggerable cationic polymers of the present disclosure are the polymerization product of a vinyl-functional cationic monomer, and one or more hydrophobic vinyl monomers with alkyl side chain sizes of up to 4 carbons long incorporated in a random manner. Additionally, a minor amount of another vinyl monomer with linear or branched alkyl groups 4 carbons or longer, alkyl hydroxy, polyoxyalkylene, or other functional groups may be employed. The ion-triggerable cationic polymers function as adhesives for tissue, airlaid pulp, and other nonwoven webs and provide sufficient in-use strength.

In one embodiment of the present disclosure, the binder composition comprises a composition having the structure:

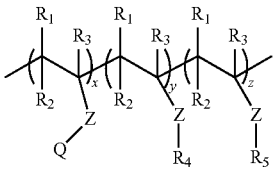

wherein x=1 to about 15 mole percent; y=about 60 to about 99 mole percent; and z=0 to about 30 mole percent; Q is selected from $C_1$-$C_4$ alkyl ammonium, quaternary $C_1$-$C_4$ alkyl ammonium and benzyl ammonium; Z is selected from —O—, —COO—, —OOC—, —CONH—, and —NHCO—; $R_1$, $R_2$, $R_3$ are independently selected from hydrogen and methyl; $R_4$ is $C_1$-$C_4$ alkyl; $R_5$ is selected from hydrogen, methyl, ethyl, butyl, ethylhexyl, decyl, dodecyl, hydroxyethyl, hydroxypropyl, polyoxyethylene, and polyoxypropylene.

Vinyl-functional cationic monomers of the present disclosure desirably include, but are not limited to, [2-(acryloxy)ethyl]trimethyl ammonium chloride (ADAMQUAT); [2-(methacryloxy)ethyl)trimethyl ammonium chloride (MADQUAT); (3-acrylamidopropyl)trimethyl ammonium chloride; N,N-diallyldimethyl ammonium chloride; [2-(acryloxy)ethyl]dimethylbenzyl ammonium chloride; (2-(methacryloxy)ethyl]dimethylbenzyl ammonium chloride; [2-(acryloxy)ethyl]dimethyl ammonium chloride; [2-(methacryloxy)ethyl]dimethyl ammonium chloride. Precursor monomers, such as vinylpyridine, dimethylaminoethyl acrylate, and dimethylaminoethyl methacrylate, which can be polymerized and quaternized through post-polymerization reactions are also possible. Monomers or quaternization reagents which provide different counter-ions, such as bromide, iodide, or methyl sulfate are also useful. Other vinyl-functional cationic monomers which may be copolymerized with a hydrophobic vinyl monomer are also useful in the present disclosure.

In some embodiments of the present disclosure, the vinyl-functional cationic monomer is selected from [2-(acryloxy)ethyl]dimethyl ammonium chloride, [2-(acryloxy)ethyl]dimethyl ammonium bromide, [2-(acryloxy)ethyl]dimethyl ammonium iodide, and [2-(acryloxy)ethyl]dimethyl ammonium methyl sulfate.

In some embodiments of the present disclosure, the vinyl-functional cationic monomer is selected from [2-(methacryloxy)ethyl]dimethyl ammonium chloride, [2-(methacryloxy)ethyl]dimethyl ammonium bromide, [2-(methacryloxy)ethyl]dimethyl ammonium iodide, and [2-(methacryloxy)ethyl]dimethyl ammonium methyl sulfate.

In some embodiments of the present disclosure, the vinyl-functional cationic monomer is selected from [2-(acryloxy)ethyl]trimethyl ammonium chloride, [2-(acryloxy)ethyl]trimethyl ammonium bromide, [2-(acryloxy)ethyl]trimethyl ammonium iodide, and [2-(acryloxy)ethyl]trimethyl ammonium methyl sulfate.

In some embodiments of the present disclosure, the vinyl-functional cationic monomer is selected from [2-(methacryloxy)ethyl]trimethyl ammonium chloride, [2-(methacryloxy)ethyl]trimethyl ammonium bromide, [2-(methacryloxy)ethyl]trimethyl ammonium iodide, and [2-(methacryloxy)ethyl]trimethyl ammonium methyl sulfate.

In some embodiments of the present disclosure, the vinyl-functional cationic monomer is selected from (3-acrylamidopropyl)trimethyl ammonium chloride, (3-acrylamidopropyl)trimethyl ammonium bromide, (3-acrylamidopropyl)trimethyl ammonium iodide, and (3-acrylamidopropyl)trimethyl ammonium methyl sulfate.

In some embodiments of the present disclosure, the vinyl-functional cationic monomer is selected from N,N-diallyldimethyl ammonium chloride, N,N-diallyldimethyl ammonium bromide, N,N-diallyldimethyl ammonium iodide, and N,N-diallyldimethyl ammonium methyl sulfate.

In some embodiments of the present disclosure, the vinyl-functional cationic monomer is selected from [2-(acryloxy)ethyl]dimethylbenzyl ammonium chloride, [2-(acryloxy)ethyl]dimethylbenzyl ammonium bromide, [2-(acryloxy)ethyl]dimethylbenzyl ammonium iodide, and [2-(acryloxy)ethyl]dimethylbenzyl ammonium methyl sulfate.

In some embodiments of the present disclosure, the vinyl-functional cationic monomer is selected from [2-(methacryloxy)ethyl]dimethylbenzyl ammonium chloride, [2-(methacryloxy)ethyl]dimethylbenzyl ammonium bromide, [2-(methacryloxy)ethyl]dimethylbenzyl ammonium iodide, and [2-(methacryloxy)ethyl]dimethylbenzyl ammonium methyl sulfate.

Desirable hydrophobic monomers for use in the ion-sensitive cationic polymers of the present disclosure include, but are not limited to, branched or linear $C_1$-$C_{18}$ alkyl vinyl ethers, vinyl esters, acrylamides, acrylates, and other monomers that can be copolymerized with the cationic monomer. As used herein the monomer methyl acrylate is considered to be a hydrophobic monomer. Methyl acrylate has a solubility of 6 g/100 ml in water at 20° C.

In some embodiments of the present disclosure, the binder composition comprises the polymerization product of a cationic acrylate or methacrylate and one or more alkyl acrylates or methacrylates having the structure:

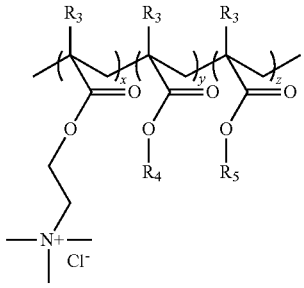

wherein x=1 to about 15 mole percent; y=about 60 to about 99 mole percent; and z=0 to about 30 mole percent; $R_4$ is $C_1$-$C_4$ alkyl; R5 is selected from hydrogen, methyl, ethyl, butyl, ethylhexyl, decyl, dodecyl, hydroxyethyl, hydroxypropyl, polyoxyethylene, and polyoxypropylene.

In other embodiments of the present disclosure, the binder composition has the structure:

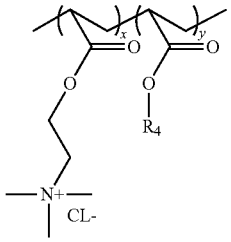

wherein x=1 to about 15 mole percent; y=about 85 to about 99 mole percent and $R_4$ is $C_1$-$C_4$ alkyl. In yet other embodiments of the present disclosure, x=about 3 to about 6 mole percent, y=about 94 to about 97 mole percent and $R_4$ is methyl. The ion-triggerable cationic polymers of the present disclosure may have an average molecular weight that varies depending on the ultimate use of the polymer. The ion-triggerable cationic polymers of the present disclosure have a weight average molecular weight ranging from about 10,000 to about 5,000,000 grams per mol. More specifically, the ion-triggerable cationic polymers of the present disclosure have a weight average molecular weight ranging from about 25,000 to about 2,000,000 grams per mol., or, more specifically still, from about 200,000 to about 1,000,000 grams per mol.

The ion-triggerable cationic polymers of the present disclosure may be prepared according to a variety of polymerization methods, desirably a solution polymerization method. Suitable solvents for the polymerization method include, but are not limited to, lower alcohols, such as methanol, ethanol and propanol; a mixed solvent of water and one or more lower alcohols mentioned above; and a mixed solvent of water and one or more lower ketones, such as acetone or methyl ethyl ketone.

In the polymerization methods of the present disclosure, any free radical polymerization initiator may be used. Selection of a particular initiator may depend on a number of factors including, but not limited to, the polymerization temperature, the solvent, and the monomers used. Suitable polymerization initiators for use in the present disclosure include, but are not limited to, 2,2'-azobisisobutyronitrile, 2,2'-azobis(2-methylbutyronitrile), 2,2'-azobis(2,4-dimethylvaleronitrile), 2,2'-azobis(2-amidinopropane)dihydrochloride, 2,2'-azobis(N,N'-dimethyleneisobutylamidine), potassium persulfate, ammonium persulfate, and aqueous hydrogen peroxide. The amount of polymerization initiator may desirably range from about 0.01 to 5 weight percent based on the total weight of monomer present.

The polymerization temperature may vary depending on the polymerization solvent, monomers, and initiator used, but in general, ranges from about 20° C. to about 90° C. Polymerization time generally ranges from about 2 to about 8 hours.

In a further embodiment of the present disclosure, the above-described ion-triggerable cationic polymer formulations are used as binder materials for flushable and/or non-flushable products. In order to be effective as a binder material in flushable products throughout the United States, the ion-triggerable cationic polymer formulations of the present disclosure remain stable and maintain their integrity while dry or in relatively high concentrations of monovalent and/or divalent ions, but become soluble in water containing up to about 200 ppm or more divalent ions, especially calcium and magnesium. Desirably, the ion-triggerable cationic polymer formulations of the present disclosure are insoluble in a salt solution containing at least about 0.3 weight percent of one or more inorganic and/or organic salts containing monovalent and/or divalent ions. More desirably, the ion-triggerable cationic polymer formulations of the present disclosure are insoluble in a salt solution containing from about 0.3% to about 10% by weight of one or more inorganic and/or organic salts containing monovalent and/or divalent ions. Even more desirably, the ion-triggerable cationic polymer formulations of the present disclosure are insoluble in salt solutions containing from about 0.5% to about 5% by weight of one or more inorganic and/or organic salts containing monovalent and/or divalent ions. Especially desirably, the ion-triggerable cationic polymer formulations of the present disclosure are insoluble in salt solutions containing from about 1.0% to about 4.0% by weight of one or more inorganic and/or organic salts containing monovalent and/or divalent ions. Suitable monovalent ions include, but are not limited to, $Na^+$ ions, $K^+$ ions, $Li^+$ ions, $NH_4^+$ ions, low molecular weight quaternary ammonium compounds (e.g., those having fewer than 5 carbons on any side group), and a combination thereof. Suitable multivalent ions include, but are not limited to, $Zn^{2+}$, $Ca^{2+}$ and $Mg^{2+}$. The monovalent and divalent ions can be derived from organic and inorganic salts including, but not limited to, NaCl, NaBr, KCl, $NH_4Cl$, $Na_2SO_4$, $ZnCl_2$, $CaCl_2$, $MgCl_2$, $MgSO_4$, $NaNO_3$, $NaSO_4CH_3$, and combinations thereof. Typically, alkali metal halides are most desirable because of cost, purity, low toxicity, and availability. A particularly desirable salt is NaCl.

Based on a study conducted by the American Chemical Society, water hardness across the United States varies greatly, with $CaCO_3$ concentration ranging from near zero for soft water to about 500 ppm $CaCO_3$ (about 200 ppm $Ca^{2+}$ ion) for very hard water. To ensure polymer formulation dispersibility across the country (and throughout the whole world), the ion-triggerable cationic polymer formulations of the present disclosure are desirably soluble in water containing up to about 50 ppm $Ca^{2+}$ and/or $Mg^{2+}$ ions. More desirably, the ion-triggerable cationic polymer formulations of the present disclosure are soluble in water containing up to about 100 ppm $Ca^{2+}$ and/or $Mg^{2+}$ ions. Even more desirably, the ion-triggerable cationic polymer formulations of the present disclosure are soluble in water containing up to about 150 ppm $Ca^{2+}$ and/or $Mg^{2+}$ ions. Even more desirably, the ion-triggerable cationic polymer formulations of the present disclosure are soluble in water containing up to about 200 ppm $Ca^{2+}$ and/or $Mg^{2+}$ ions.

Co-Binder Polymers

As stated above, the cationic polymer formulations of the present disclosure are formed from a single triggerable cationic polymer or a combination of two or more different polymers, wherein at least one polymer is a triggerable polymer. The second polymer may be a co-binder polymer. A co-binder polymer is of a type and in an amount such that when combined with the triggerable cationic polymer, the co-binder polymer desirably is largely dispersed in the triggerable cationic polymer; i.e., the triggerable cationic polymer is desirably the continuous phase and the co-binder polymer is desirably the discontinuous phase. Desirably, the co-binder polymer can also meet several additional criteria. For example, the co-binder polymer can have a glass transition temperature; i.e., $T_g$, that is lower than the glass transition temperature of the ion-triggerable cationic polymer. Furthermore or alternatively, the co-binder polymer can be insoluble in water, or can reduce the shear viscosity of the ion-triggerable cationic polymer. The co-binder can be present at a level relative to the solids mass of the triggerable polymer of about 45% or less, specifically about 30% or less, more specifically about 20% or less, more specifically still about 15% or less, and most specifically about 10% or less, with exemplary ranges of from about 1% to about 45% or from about 25% to about 35%, as well as from about 1% to about 20% or from about 5% to about 25%. The amount of co-binder present should be low enough, for co-binders with the potential to form water insoluble bonds or films, that the co-binder remains a discontinuous phase unable to create enough crosslinked, or insoluble bonds, to jeopardize the dispersibility of the treated substrate.

Desirably, but not necessarily, the co-binder polymer when combined with the ion-triggerable cationic polymer will reduce the shear viscosity of the ion-triggerable cationic polymer to such an extent that the combination of the ion-triggerable cationic polymer and the co-binder polymer is sprayable. By sprayable is meant that the polymer can be applied to a nonwoven fibrous substrate by spraying and the distribution of the polymer across the substrate and the penetration of the polymer into the substrate are such that the polymer formulation is uniformly applied to the substrate.

In some embodiments, the combination of the ion-triggerable cationic polymer and the co-binder polymer can reduce the stiffness of the article to which it is applied compared to the article with just the ion-triggerable cationic polymer.

The co-binder polymer of the present disclosure can have an average molecular weight, which varies depending on the ultimate use of the polymer. Desirably, the co-binder polymer has a weight average molecular weight ranging from about 500,000 to about 200,000,000 grams per mol. More desirably, the co-binder polymer has a weight average molecular weight ranging from about 500,000 to about 100,000,000 grams per mol.

The co-binder polymer can be in the form of an emulsion latex. The surfactant system used in such a latex emulsion should be such that it does not substantially interfere with the dispersibility of the ion-triggerable cationic polymer. Therefore, weakly anionic, nonionic, or cationic latexes may be useful for the present disclosure. In one embodiment, the ion-triggerable cationic polymer formulations of the present disclosure comprises about 55 to about 95 weight percent ion-triggerable cationic polymer and about 5 to about 45 weight percent poly(ethylene-vinyl acetate). More desirably, the ion-triggerable cationic polymer formulations of the present disclosure comprises about 75 weight percent ion-triggerable cationic polymer and about 25 weight percent poly(ethylene-vinyl acetate). A particularly preferred non-crosslinking poly(ethylene-vinyl acetate) is Dur-O-Set® RB available from National Starch and Chemical Co., Bridgewater, N.J.

When a latex co-binder, or any potentially crosslinkable co-binder, is used the latex should be prevented from forming substantial water-insoluble bonds that bind the fibrous substrate together and interfere with the dispersibility of the article. Thus, the latex can be free of crosslinking agents, such as N-methylol-acrylamide (NMA), or free of catalyst for the crosslinker, or both. Alternatively, an inhibitor can be added that interferes with the crosslinker or with the catalyst such that crosslinking is impaired even when the article is heated to normal crosslinking temperatures. Such inhibitors can include free radical scavengers, methyl hydroquinone, t-butylcatechol, pH control agents such as potassium hydroxide, and the like. For some latex crosslinkers, such as N-methylol-acrylamide (NMA), for example, elevated pH such as a pH of 8 or higher can interfere with crosslinking at normal crosslinking temperatures (e.g., about 130° C. or higher). Also alternatively, an article comprising a latex co-binder can be maintained at temperatures below the temperature range at which crosslinking takes place, such that the presence of a crosslinker does not lead to crosslinking, or such that the degree of crosslinking remains sufficiently low that the dispersibility of the article is not jeopardized. Also alternatively, the amount of crosslinkable latex can be kept below a threshold level such that even with crosslinking, the article remains dispersible. For example, a small quantity of crosslinkable latex dispersed as discrete particles in an ion-sensitive binder can permit dispersibility even when fully crosslinked. For the later embodiment, the amount of latex can be below about 20 weight percent, and, more specifically, below about 15 weight percent relative to the ion-sensitive binder.

Latex compounds, whether crosslinkable or not, need not be the co-binder. SEM micrography of successful ion-sensitive binder films with useful non-crosslinking latex emulsions dispersed therein has shown that the latex co-binder particles can remain as discrete entities in the ion-sensitive binder, possibly serving in part as filler material. It is believed that other materials could serve a similar role, including a dispersed mineral or particulate filler in the triggerable binder, optionally comprising added surfactants/dispersants. For example, in one envisioned embodiment, freeflowing Ganzpearl PS-8F particles from Presperse, Inc.

(Piscataway, N.J.), a styrene/divinylbenzene copolymer with about 0.4 micron particles, can be dispersed in a triggerable binder at a level of about 2 to 10 weight percent to modify the mechanical, tactile, and optical properties of the triggerable binder. Other filler-like approaches may include microparticles, microspheres, or microbeads of metal, glass, carbon, mineral, quartz, and/or plastic, such as acrylic or phenolic, and hollow particles having inert gaseous atmospheres sealed within their interiors. Examples include EXPANCEL phenolic microspheres from Expancel of Sweden, which expand substantially when heated, or the acrylic microspheres known as PM 6545 available from PQ Corporation of Pennsylvania. Foaming agents, including $CO_2$ dissolved in the triggerable binder, could also provide helpful discontinuities as gas bubbles in the matrix of an triggerable binder, allowing the dispersed gas phase in the triggerable binder to serve as the co-binder. In general, any compatible material that is not miscible with the binder, especially one with adhesive or binding properties of its own, can be used as the co-binder, if it is not provided in a state that imparts substantial covalent bonds joining fibers in a way that interferes with the water-dispersibility of the product. However, those materials that also provide additional benefits, such as reduced spray viscosity, can be especially preferred. Adhesive co-binders, such as latex that do not contain crosslinkers or contain reduced amounts of crosslinkers, have been found to be especially helpful in providing good results over a wide range of processing conditions, including drying at elevated temperatures.

The co-binder polymer can comprise surface active compounds that improve the wettability of the substrate after application of the binder mixture. Wettability of a dry substrate that has been treated with a triggerable polymer formulation can be a problem in some embodiments, because the hydrophobic portions of the triggerable polymer formulation can become selectively oriented toward the air phase during drying, creating a hydrophobic surface that can be difficult to wet when the wetting composition is later applied unless surfactants are added to the wetting composition. Surfactants, or other surface active ingredients, in co-binder polymers can improve the wettability of the dried substrate that has been treated with a triggerable polymer formulation. Surfactants in the co-binder polymer should not significantly interfere with the triggerable polymer formulation. Thus, the binder should maintain good integrity and tactile properties in the pre-moistened wipes with the surfactant present.

In one embodiment, an effective co-binder polymer replaces a portion of the ion-triggerable cationic polymer formulation and permits a given strength level to be achieved in a pre-moistened wipe with at least one of lower stiffness, better tactile properties (e.g., lubricity or smoothness), or reduced cost, relative to an otherwise identical pre-moistened wipe lacking the co-binder polymer and comprising the ion-triggerable cationic polymer formulation at a level sufficient to achieve the given tensile strength.

Other Co-Binder Polymers

The Dry Emulsion Powder (DEP) binders of Wacker Polymer Systems (Burghausen, Germany) such as the VINNEK® system of binders, can be applied in some embodiments of the present disclosure. These are redispersible, free flowing binder powders formed from liquid emulsions. Small polymer particles from a dispersion are provided in a protective matrix of water soluble protective colloids in the form of a powder particle. The surface of the powder particle is protected against caking by platelets of mineral crystals. As a result, polymer particles that once were in a liquid dispersion are now available in a free flowing, dry powder form that can be redispersed in water or turned into swollen, tacky particles by the addition of moisture. These particles can be applied in highloft nonwovens by depositing them with the fibers during the airlaid process, and then later adding 10% to 30% moisture to cause the particles to swell and adhere to the fibers. This can be called the "chewing gum effect," meaning that the dry, non-tacky fibers in the web become sticky like chewing gum once moistened. Good adhesion to polar surfaces and other surfaces is obtained. These binders are available as free flowing particles formed from latex emulsions that have been dried and treated with agents to prevent cohesion in the dry state. They can be entrained in air and deposited with fibers during the airlaid process, or can be applied to a substrate by electrostatic means, by direct contact, by gravity feed devices, and other means. They can be applied apart from the binder, either before or after the binder has been dried. Contact with moisture, either as liquid or steam, rehydrates the latex particles and causes them to swell and to adhere to the fibers. Drying and heating to elevated temperatures (e.g., above 160° C.) causes the binder particles to become crosslinked and water resistant, but drying at lower temperatures (e.g., at 110° C. or less) can result in film formation and a degree of fiber binding without seriously impairing the water dispersibility of the pre-moistened wipes. Thus, it is believed that the commercial product can be used without reducing the amount of crosslinker by controlling the curing of the co-binder polymer, such as limiting the time and temperature of drying to provide a degree of bonding without significant crosslinking.

As pointed out by Dr. Klaus Kohlhammer in "New Airlaid Binders," Nonwovens Report International, September 1999, issue 342, pp. 20-22, 28-31, dry emulsion binder powders have the advantage that they can easily be incorporated into a nonwoven or airlaid web during formation of the web, as opposed to applying the material to an existing substrate, permitting increased control over placement of the co-binder polymer. Thus, a nonwoven or airlaid web can be prepared already having dry emulsion binders therein, followed by moistening when the ion-triggerable cationic polymer formulation solution is applied, whereupon the dry emulsion powder becomes tacky and contributes to binding of the substrate. Alternatively, the dry emulsion powder can be entrapped in the substrate by a filtration mechanism after the substrate has been treated with triggerable binder and dried, whereupon the dry emulsion powder is rendered tacky upon application of the wetting composition.

In another embodiment, the dry emulsion powder is dispersed into the triggerable polymer formulation solution either by application of the powder as the ion-triggerable cationic polymer formulation solution is being sprayed onto the web or by adding and dispersing the dry emulsion powder particles into the ion-triggerable cationic polymer formulation solution, after which the mixture is applied to a web by spraying, by foam application methods, or by other techniques known in the art.

Exemplary Methods of Measurement

In some embodiments of the present disclosure the hydroentangled fibers may be produced as exemplified in the following method. The first plurality of jets 30 can be provided by first and second manifolds and the second plurality of jets 50 can be provided by third, fourth and fifth manifolds. The support fabric rate of travel can be 30 meters per minute. The first manifold pressure can be 35 bars, the second manifold pressure can be 75 bars, the first and second manifolds both can be 120 micrometer orifices spaced 1800 micrometers apart in the cross-machine direction, and the third, fourth and fifth manifolds each can be 120 micrometer orifices spaced 600 micrometers apart in the cross-machine direction. The hydroentangling energy E in kilowatt-hours per kilogram imparted to the web can be calculated by the summing the energy over each of the injectors (i):

$$E = 0.278\sum_i \frac{Q_i P_i}{M_r}$$

where $P_i$ is the pressure in Pascals for injector i, $M_r$ is the mass of sheet passing under the injector per second in kilograms per second (calculated by multiplying the basis weight of the sheet by the web velocity), and $Q_i$ is the volume flow rate out of injector i in cubic meters per second, calculated according to:

$$Q_i = N_i \frac{0.8 D_i^2 \pi}{4} \sqrt{\frac{2P_i}{\rho}}$$

where $N_i$ is the number of nozzles per meter width of injector i, $D_i$ is the nozzle diameter in meters, ρ is the density of the hydroentangling water in kilograms per cubic meter, and 0.8 is used as the nozzle coefficient for all nozzles.

The strength of the dispersible nonwoven sheets 80 generated from each example can be evaluated by measuring the tensile strength in the machine direction 24 and the cross-machine direction 25. Tensile strength can be measured using a Constant Rate of Elongation (CRE) tensile tester having a 1-inch jaw width (sample width), a test span of 3 inches (gauge length), and a rate of jaw separation of 25.4 centimeters per minute after soaking the sheet in tap water for 4 minutes and then draining the sheet on dry Viva® brand paper towel for 20 seconds. This drainage procedure can result in a moisture content of 200 percent of the dry weight+/−50 percent. This can be verified by weighing the sample before each test. One-inch wide strips can be cut from the center of the dispersible nonwoven sheets 80 in the specified machine direction 24 ("MD") or cross-machine direction 25 ("CD") orientation using a JDC Precision Sample Cutter (Thwing-Albert Instrument Company, Philadelphia, Pa., Model No. JDC3-10, Serial No. 37333). The "MD tensile strength" is the peak load in grams-force per inch of sample width when a sample is pulled to rupture in the machine direction. The "CD tensile strength" is the peak load in grams-force per inch of sample width when a sample is pulled to rupture in the cross direction.

The instrument used for measuring tensile strength can be an MTS Systems Synergie 200 model and the data acquisition software can be MTS TestWorks® for Windows Ver. 4.0 commercially available from MTS Systems Corp., Eden Prairie, Minn. The load cell can be an MTS 50 Newton maximum load cell. The gauge length between jaws can be 3±0.04 inches and the top and bottom jaws can be operated using pneumatic-action with maximum 60 P.S.I. The break sensitivity can be set at 70 percent. The data acquisition rate can be set at 100 Hz (i.e., 100 samples per second). The sample can be placed in the jaws of the instrument, centered both vertically and horizontally. The test can be then started and ended when the force drops by 70 percent of peak. The peak load can be expressed in grams-force and can be recorded as the "MD tensile strength" of the specimen. As used herein, the "geometric mean tensile strength" ("GMT") is the square root of the product of the wet machine direction tensile strength multiplied by the wet cross-machine direction tensile strength and is expressed as grams per inch of sample width. All of these values are for in-use tensile strength measurements.

The Soak Wet Strength was carried out by soaking the 1" wide strips described above for the tensile testing in a bath of 4.1 liter of deionized water for 1 hour. The deionized water was not stirred or agitated in any way during the testing. At the completion of the 1 hour soak, each of the samples were carefully retrieved from the bath, allowed to drain to remove excess water, and then tested immediately as described above for the tensile testing.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The Slosh-Box Test uses a bench-scaled apparatus to evaluate the breakup or dispersibility of flushable consumer products as they travel through the wastewater collection system. In this test, a clear plastic tank is loaded with a product and tap water or raw wastewater. The container is then moved up and down by a cam system at a specified rotational speed to simulate the movement of wastewater in the collection system. The initial breakup point and the time for dispersion of the product into pieces measuring 1 inch by 1 inch (25 mm by 25 mm) are recorded in the laboratory notebook. This 1 inch by 1 inch (25 mm by 25 mm) size is a parameter that is used because it reduces the potential of product recognition. The various components of the product can then be screened and weighed to determine the rate and level of disintegration.

The slosh-box water transport simulator may consist of a transparent plastic tank that can be mounted on an oscillating platform with speed and holding time controller. The angle of incline produced by the cam system produces a water motion equivalent to 60 cm/s (2 ft/s), which is the minimum design standard for wastewater flow rate in an enclosed collection system. The rate of oscillation was controlled mechanically by the rotation of a cam and level system and was measured periodically throughout the test. This cycle mimics the normal back-and forth movement of wastewater as it flows through sewer pipe.

Room temperature tap water can be placed in the plastic container/tank. The timer can be set for six hours (or longer) and cycle speed can be set for 26 rpm. The pre-weighed product can be placed in the tank and observed as it undergoes (t) the agitation period. The time to first breakup and full dispersion can be recorded in the laboratory notebook.

The test can be terminated when the product reaches a dispersion point of no piece larger than 1 inch by 1 inch (25 mm by 25 mm) square in size. At this point, the clear plastic tank can be removed from the oscillating platform. The entire contents of the plastic tank can then be poured through a nest of screens arranged from top to bottom in the following order: 25.40 mm, 12.70 mm, 6.35 mm, 3.18 mm, 1.59 mm (diameter opening). With a showerhead spray nozzle held approximately 10 to 15 cm (4 to 6 in) above the sieve, the material can be gently rinsed through the nested screens for two minutes at a flow rate of 4 L/min (1 gal/min) being careful not to force passage of the retained material through the next smaller screen. After two minutes of rinsing, the top screen can be removed and the rinsing can be continued for the next smaller screen, still nested, for two additional minutes. After rinsing, the retained material can be removed from each of the screens using forceps. The contents can be transferred from each screen to a separate, labeled aluminum weigh pan. The pan can be placed in a drying oven overnight at 103±3° C. The dried samples can be allowed to cool down in a desiccator. After all the samples are dry, the materials from each of the retained fractions can be weighed and the percentage of disintegration based on the initial starting weight of the test material can be calculated.

EXAMPLES

The following Examples describe or illustrate various embodiments of the present disclosure. Other embodiments within the scope of the appended claims will be apparent to a skilled artisan considering the specification or practice of the disclosure as described herein. It is intended that the specification, together with the Examples, be considered exemplary only, with the scope and spirit of the disclosure being indicated by the claims, which follow the Example.

Example 1—Slosh-Box Time to 25 mm vs. MD Wet Load (g/in)

Figure 8:
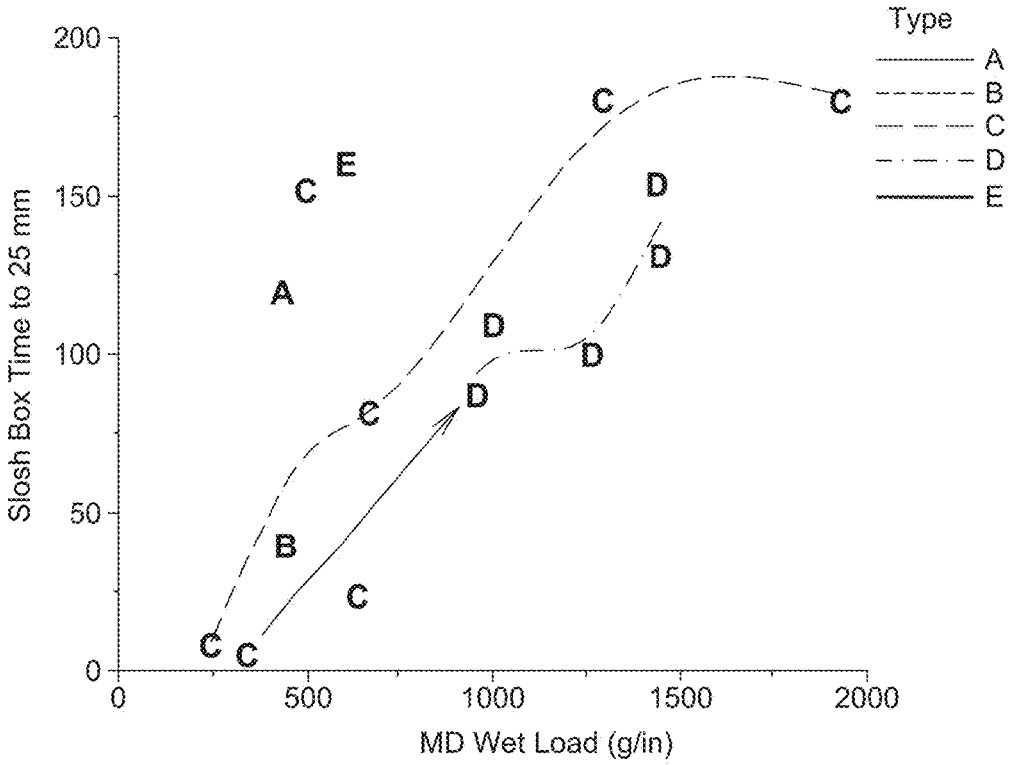
FIG. 8 is a graphical depiction of Slosh-Box time vs. MD Wet Load of various wipe products, including a dispersible moist wipe in accordance with the present disclosure.

Example 1 studied the slosh-box time to 25 mm vs. MD wet load (g/in) of various conventional wipes/sheets known in the industry and the dispersible moist wipe of the present disclosure. FIG. 8 depicts the graphical results of the following sheets tested: (A) an airlaid basesheet with ion-triggerable cationic polymer; (B) an optimized airlaid basesheet with optimized ion-triggerable cationic polymer; (C) a sheet including hydroentangled fibers but without a binder add-on; (D) a sheet in accordance with the present disclosure including hydroentangled fibers and a binder add-on; and, (E) a sheet including CHARMIN® FRESHMATES hydraspun.

Sheet (C) in FIG. 8 is a lightly hydroentangled sheet without any binder add-on. Sheet (D) in this example included from about 1.3 to about 4 gsm of binder on the hydroentangled sheet of sheet (C). Thus, as shown in FIG. 8, the binder increases the strength of a low-density, lightly hydroentangled sheet. Not only is the strength of the sheet greatly increased, but the slosh-box break-up time is less than about 150 minutes. Thus, the combination of the binder composition and the hydroentangled fibers not only increases initial wet strength of the sheet but also gives the sheet good dispersibility.

Example 2—GMT Soak Wet Strength (g/in) vs. GMT Wet Strength (g/in)

Figure 9:
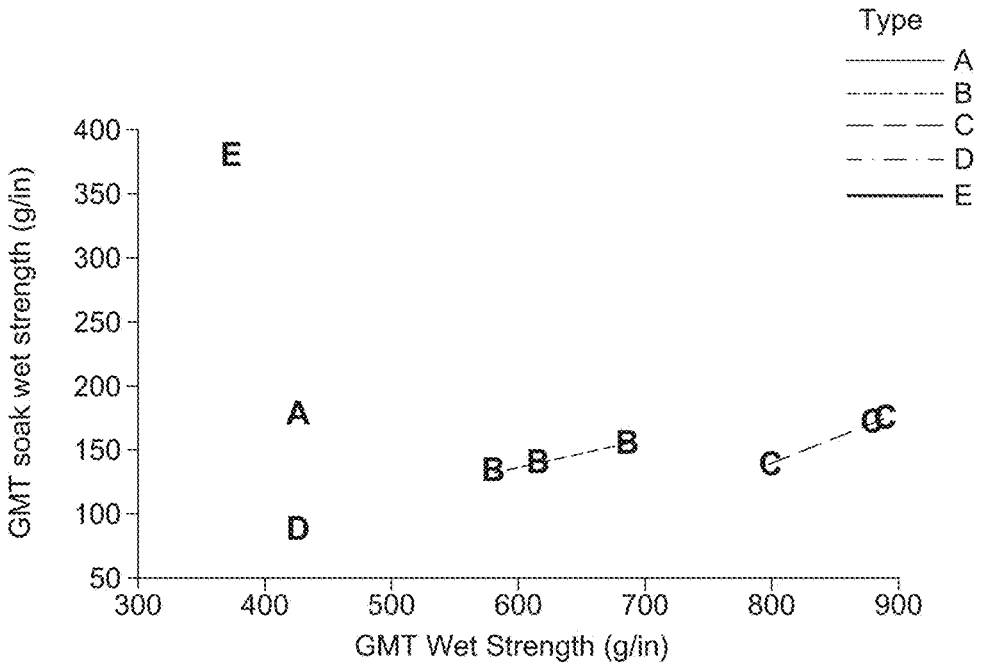
FIG. 9 is a graphical depiction of GMT Soak Wet Strength vs. GMT Wet Strength of various wipe products, including dispersible moist wipes in accordance with the present disclosure.

Example 2 studied the GMT soak wet strength (g/in) vs. the GMT wet strength (g/in) of conventional sheets used in the industry and the sheets (i.e., moist wipes) of the present disclosure. Thus, this example tested the initial wet strength of a sheet as well as the ability to disperse in water after use. FIG. 9 is a graphical depiction of the following sheets tested: (A) an airlaid basesheet with ion-triggerable cationic polymer; (B) a sheet in accordance with the present disclosure comprising hydroentangled fibers and a binder add-on of 1.28 gsm of ion-triggerable cationic polymer; (C) a sheet in accordance with the present disclosure comprising hydroentangled fibers and a binder add-on of 2.2 gsm of ion-triggerable cationic polymer (D) an optimized airlaid basesheet with optimized ion-triggerable cationic polymer; and, (E) a sheet including CHARMIN® FRESHMATES hydraspun.

The results of the testing are disclosed in Table 1

TABLE 1

| Sheet | Binder add-on (gsm) | GMT Wet Strength (g/in) | GMT Soak Strength (g/in) | Slosh-Box Time @ 15° C. | Cure Time (s) |
|---|---|---|---|---|---|
| B1 (HET + ion-triggerable cationic polymer) | 1.28 | 578 | 135 | 87.4 | 12 |
| B2 (HET + ion-triggerable cationic polymer) | 1.28 | 612 | 141 | 109.2 | 18 |
| B3 (HET + ion-triggerable cationic polymer) | 1.28 | 684 | 155 | N/A* | 25 |
| C1 (HET + ion-triggerable cationic polymer) | 2.2 | 795 | 141 | 100.3 | 12 |
| C2 (HET + ion-triggerable cationic polymer) | 2.2 | 874 | 170 | 131.1 | 18 |
| C3 (HET + ion-triggerable cationic polymer) | 2.2 | 885 | 175 | N/A* | 25 |
| Airlaid with ion-triggerable cationic polymer | 12.5 | 425 | 180 | 120 | 15 |
| Airlaid with optimized ion-triggerable cationic polymer | 12.5 | 425 | 90 | 40 | 15 |
| CHARMIN ® FRESHMATES Hydraspun | N/A | 370 | 380 | 140 | N/A |

*B3 and C3 were not tested for Slosh-Box times

As can be seen from the results, not only do the sheets comprising hydroentangled fibers and binder (sheets B and C) exhibit a greater initial wet strength, but they also have a sufficiently lower soak wet strength. Thus, the sheets in accordance with the present disclosure (sheets B and C) are strong enough when moist to wipe without ripping or poking through, and they are also dispersible enough to break up in the sewer or septic system. One having ordinary skill in the art would have expected that a sheet with the high initial wet strengths of sheets B and C would not lose strength without agitation. Sheets B and C, however, despite their high starting strength, lose greater than about 75% of their initial strength when soaked in deionized water for an hour. This is in contrast to how conventional hydroentangled sheets perform, such as sheet E in FIG. 9, which does not lose strength in the water unless agitated.

As can been seen in FIG. 9, sheets B and C demonstrate an improved result over the conventional sheets used in the industry. That is, for example, sheets A and D have a relatively low soak wet strength and thus may be adequately dispersible in a sewer, but sheets A and D have a much lower initial wet strength and thus are not able to withstand as much wiping without ripping or poking through. Sheet E, conversely, has both a lower initial wet strength and a higher soak wet strength, making it much harder to disperse within a sewer system.

Thus, the inventors of the present disclosure have surprisingly and unexpectedly found that through the combination of hydroentangled fibers and a binder composition, a dispersible moist wipe can be created that overcomes the shortcomings and issues of conventional wipes used by providing a wipe with both a high initial wet strength and a low enough soak wet strength to be dispersible in sewers/septic systems, etc.

Example 3—CD Stretch % & Wet Density (g/ccm) vs. GMT Wet Strength (g/in)

Example 3 examined the CD stretch % and wet density (g/ccm) vs. GMT wet strength (g/in) sheets (i.e., dispersible moist wipes) in accordance with the present disclosure. The sheets tested in Example 3 are sheets B and sheets C from Example 2. Initially, the inventors expected that the addition of the binder to the sheets would have caused a "locking up" of the stretching capabilities of the sheet and cause the sheet to collapse and lose bulk. This happens in conventional sheets that include binder as it is known that an unbonded fluff mat has much more bulk and stretch than the bonded sheet after binder application.

Figure 10:
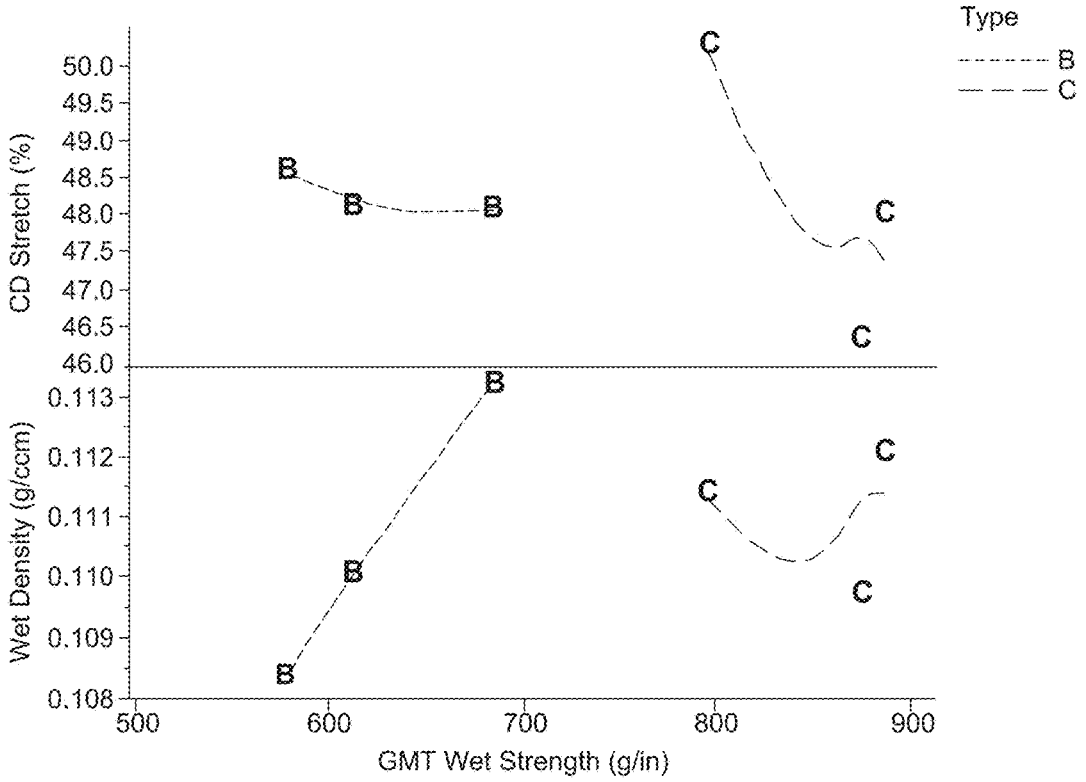
FIG. 10 is a graphical depiction of CD Stretch % & Wet Density vs. GMT Wet Strength of dispersible moist wipes in accordance with the present disclosure.

As can be seen in FIG. 10, however, not only do sheets B and C have high initial wet strength, but sheets B and C also show very good stretchability and a lower density, which one having ordinary skill in the art would not have predicted would occur. The combination of the hydroentangled fibers and binder composition surprisingly achieves this result because the swellable binder helps bind the hydroentangled fibers together so that the fibers lock under tension, but when placed in fresh water the binder swelled enough to release the locking and lubricate the fibers so that the entire structure broke apart much more easily than expected.

All documents cited in the Detailed Description are, in relevant part, incorporated herein by reference; the citation of any document is not to be construed as an admission that it is prior art with respect to the present disclosure. To the extent that any meaning or definition of a term in this written document conflicts with any meaning or definition of the term in a document incorporated by references, the meaning or definition assigned to the term in this written document shall govern.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A dispersible moist wipe comprising hydroentangled fibers and from about 0.5 grams per square meter (gsm) to about 5 gsm of an ion-triggerable binder composition, the wipe having a geometric mean tensile (GMT) wet strength of at least about 300 grams per inch (g/in), a GMT soak wet strength of less than about 180 g/in, and a CD stretch percent greater than about 40%.

2. The dispersible moist wipe as set forth in claim 1 wherein the GMT wet strength is at least about 500 g/in.

3. The dispersible moist wipe as set forth in claim 2 wherein the GMT wet strength is at least about 700 g/in.

4. The dispersible moist wipe as set forth in claim 2 wherein the GMT soak strength of the wipe is less than about 160 g/in.

5. The dispersible moist wipe as set forth in claim 2 wherein the GMT soak strength of the wipe is less than about 140 g/in.

6. The dispersible moist wipe as set forth in claim 2 wherein the CD stretch percent of the wipe is between about 45% and about 55%.

7. The dispersible moist wipe as set forth in claim 2 wherein the CD stretch percent of the wipe is between about 47% and about 49%.

8. The dispersible moist wipe as set forth in claim 2 wherein the wet density is in a range from about 0.100 g/ccm to about 0.115 g/ccm.

9. The dispersible moist wipe as set forth in claim 2 wherein the wet density is in a range from about 0.110 g/ccm to about 0.112 g/ccm.

10. The dispersible moist wipe as set forth in claim 1, wherein the ion-triggerable binder composition is present in a range between about 1.2 gsm to about 2.6 gsm.

11. The dispersible moist wipe as set forth in claim 10, wherein the ion-triggerable binder composition is present in a range between about 1.8 gsm to about 2.2 gsm.

12. The dispersible moist wipe as set forth in claim 1, wherein the hydroentangled fibers comprise regenerated fibers and natural fibers.

13. The dispersible moist wipe as set forth in claim 12, wherein the natural fibers have a fiber length between about 0.5 millimeter and about 1.5 millimeters.

14. The dispersible moist wipe as set forth in claim 12, wherein the natural fibers have a length-weighted average fiber length greater than about 2 millimeters.

15. The dispersible moist wipe as set forth in claim 12, wherein the regenerated fibers have a fiber length of from about 3 millimeters to about 60 millimeters.

16. The dispersible moist wipe as set forth in claim 12, wherein the regenerated fibers have a fineness in the range of from about 0.5 denier to about 3 denier.

* * * * *